US007934345B2

(12) United States Patent
Marsh et al.

(10) Patent No.: US 7,934,345 B2
(45) Date of Patent: May 3, 2011

(54) SYSTEMS FOR BUILDING CONSTRUCTION BY ATTACHING BLOCKS WITH BOLTS AND VERTICALLY SPACED FLAT BARS

(76) Inventors: Roger F. Marsh, Alexandria, IN (US); Patricia M. Marsh, Alexandria, IN (US)

( * ) Notice: Subject to any disclaimer, the term of this patent is extended or adjusted under 35 U.S.C. 154(b) by 92 days.

(21) Appl. No.: 11/271,703

(22) Filed: Nov. 10, 2005

(65) Prior Publication Data

US 2007/0107333 A1 May 17, 2007

(51) Int. Cl.
*E02D 27/00* (2006.01)
*E04C 5/08* (2006.01)

(52) U.S. Cl. ..... 52/223.7; 52/293.2; 52/285.2

(58) Field of Classification Search ..... 52/253, 52/293.2, 295, 285.2, 418, 223.7
See application file for complete search history.

(56) References Cited

U.S. PATENT DOCUMENTS

| | | | | | |
|---|---|---|---|---|---|
| 838,844 | A | | 12/1906 | Clayton | |
| 952,305 | A | | 3/1910 | Buskirk | |
| 962,463 | A | | 6/1910 | Phillips | |
| 1,753,451 | A | * | 4/1930 | Tonnelier | 52/564 |
| 1,783,383 | A | | 12/1930 | Montrief | |
| 1,892,605 | A | | 12/1932 | Betzler | |
| 2,141,397 | A | * | 12/1938 | Locke | 52/204.2 |
| 2,212,184 | A | | 8/1940 | Powell | |
| 2,250,763 | A | * | 7/1941 | Hild | 52/279 |
| 2,929,236 | A | | 3/1960 | Steward et al. | |
| 2,963,828 | A | | 12/1960 | Belliveau | |
| 3,236,545 | A | * | 2/1966 | Parkes et al. | 285/215 |
| 3,295,286 | A | * | 1/1967 | Schaich | 52/583.1 |
| 3,296,758 | A | * | 1/1967 | Knudsen | 52/223.7 |
| 3,382,632 | A | * | 5/1968 | Grofcsik | 52/223.7 |
| 3,410,044 | A | | 11/1968 | Moog | |
| 3,511,000 | A | | 5/1970 | Keuls | |
| 3,763,609 | A | | 10/1973 | Probst | |
| 3,785,097 | A | * | 1/1974 | Seymour | 52/126.7 |
| 4,094,222 | A | | 6/1978 | Lang et al. | |
| 4,569,167 | A | * | 2/1986 | Staples | 52/92.2 |
| 4,640,071 | A | | 2/1987 | Haener | |
| 4,726,567 | A | * | 2/1988 | Greenberg | 256/19 |
| 4,757,656 | A | | 7/1988 | Powers, Jr. | |
| 4,854,097 | A | | 8/1989 | Haener | |
| 5,007,218 | A | | 4/1991 | Bengtson et al. | |
| 5,511,902 | A | | 4/1996 | Center | |
| 5,589,124 | A | | 12/1996 | Woolford et al. | |

(Continued)

OTHER PUBLICATIONS

U.S. Appl. No. 11/353,253, filed Feb. 13, 2006.

(Continued)

*Primary Examiner* — Robert J Canfield
*Assistant Examiner* — Brent W Herring
(74) *Attorney, Agent, or Firm* — Faegre & Benson LLP

(57) ABSTRACT

A mortarless masonry structure comprising a plurality of regular masonry blocks and/or bricks connected to each other by a plurality of metal bars and a plurality of standard metal threaded fasteners thereby forming a post tensioned structure. Preferably, the blocks are operatively connected to each other as a structure by simple mechanical tools. Each interconnection results in a unitized post tensioned member that, when interconnected to the adjacent members, forms a comparatively higher strength structure than systems made of mortar and reinforced mortar. The method used to create this structure is a simple, waterless, mortarless interconnection process that is completed by a series of simple individual steps of fastening the blocks and bars into a strong and durable structure. Once connected the structure is strong and durable. If desired, the structure may be disassembled and the components re-used.

14 Claims, 14 Drawing Sheets

U.S. PATENT DOCUMENTS

| | | | | |
|---|---|---|---|---|
| 5,802,792 | A | 9/1998 | Fielding et al. | |
| 5,809,732 | A | 9/1998 | Farmer, Sr. et al. | |
| 5,924,254 | A | 7/1999 | Franklin et al. | |
| 5,941,565 | A | 8/1999 | Clendenin, Jr. | |
| 6,065,265 | A | 5/2000 | Stenekes | |
| 6,098,357 | A | 8/2000 | Franklin et al. | |
| 6,138,426 | A | 10/2000 | Mork et al. | |
| 6,167,669 | B1 | 1/2001 | Lanc | |
| 6,178,714 | B1 * | 1/2001 | Carney, Jr. | 52/564 |
| 6,244,785 | B1 | 6/2001 | Richter et al. | |
| 6,282,859 | B1 * | 9/2001 | Van Der Heijden | 52/585.1 |
| 6,321,498 | B1 | 11/2001 | Trovato | |
| 6,431,797 | B2 * | 8/2002 | Greenberg | 405/284 |
| 6,513,296 | B1 | 2/2003 | Baden | |
| 6,557,316 | B2 * | 5/2003 | Van Der Heijden | 52/585.1 |
| 6,632,048 | B2 * | 10/2003 | Greenberg | 405/284 |
| 6,665,992 | B2 * | 12/2003 | Hew | 52/562 |
| 6,691,471 | B2 | 2/2004 | Price | |
| 6,758,020 | B2 | 7/2004 | Cerrato | |
| 6,904,728 | B2 * | 6/2005 | Stutts | 52/233 |
| 6,915,614 | B2 * | 7/2005 | Matsufuji | 52/600 |
| 6,955,015 | B2 | 10/2005 | Manthei | |
| 7,124,550 | B1 * | 10/2006 | Deming | 52/745.21 |
| 7,415,805 | B2 | 8/2008 | Nickerson | |
| 7,461,490 | B2 | 12/2008 | Toledo | |
| 2002/0041796 | A1 | 4/2002 | Greenberg | |
| 2002/0134040 | A1 * | 9/2002 | Hew | 52/426 |
| 2004/0020145 | A1 * | 2/2004 | Matsufuji | 52/223.7 |
| 2004/0144059 | A1 | 7/2004 | Keshmiri | |
| 2005/0183362 | A1 * | 8/2005 | McCarthy | 52/295 |
| 2006/0168906 | A1 | 8/2006 | Tonyan et al. | |
| 2006/0201082 | A1 * | 9/2006 | Hammer et al. | 52/223.5 |
| 2007/0017176 | A1 * | 1/2007 | Gray | 52/605 |
| 2007/0056235 | A1 * | 3/2007 | Kohler | 52/223.7 |
| 2007/0186502 | A1 * | 8/2007 | Marsh et al. | 52/604 |
| 2008/0256894 | A1 | 10/2008 | Marsh et al. | |

OTHER PUBLICATIONS

U.S. Appl. No. 11/977,470, filed Oct. 25, 2007.

U.S. Appl. No. 12/148,501, filed Apr. 18, 2008.

"Embed" and "Contiguous" Webster's Dictionary.

Canadian Intellectual Property Office, Examination Report, Application No. 2,627,760, Nov. 4, 2009.

Canadian Intellectual Property Office, Examination Report, Application No. 2,642,393, Mar. 15, 2010.

International Search Report and Written Opinion of the International Searching Authority, PCT/US06/17364, Aug. 7, 2007.

International Search Report and Written Opinion of the International Searching Authority, PCT/US06/17523, Sep. 18, 2007.

International Search Report and Written Opinion of the International Searching Authority, PCT/US08/060913, Aug. 21, 2008.

International Search Report and Written Opinion of the International Searching Authority, PCT/US07/082488, Sep. 9, 2008.

Danish Patent and Trademark Office Singapore Written Opinion, Application No. 200803325-0, Apr. 22, 2009.

Australian Government, IP Australia, Intellectual Properly Office of Singapore, Written Opinion, Application No. 200805986-7, mailed Jul. 21, 2009.

Hungarian Patent Office, Intellectual Property Office of Singapore. Written Opinion, Application No. 2009028671, mailed Apr. 15, 2010.

State Intellectual Property Office of the People's Republic of China, Office Action, Application No. 200680053837.6, mailed Apr. 1, 2010.

State Intellectual Property Office of the People's Republic of China , Office Action, Application No. 200680042078.3, mailed Dec. 25, 2009.

* cited by examiner

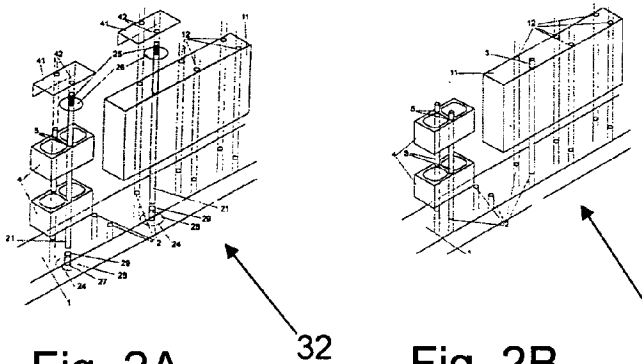
Fig. 2A
Fig. 2B
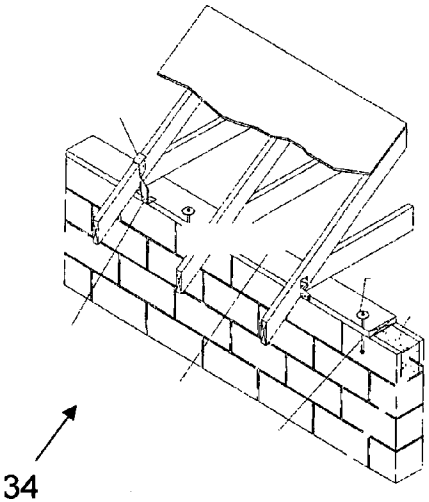
Fig. 2C
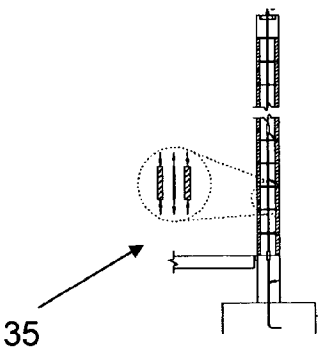
Fig. 2D
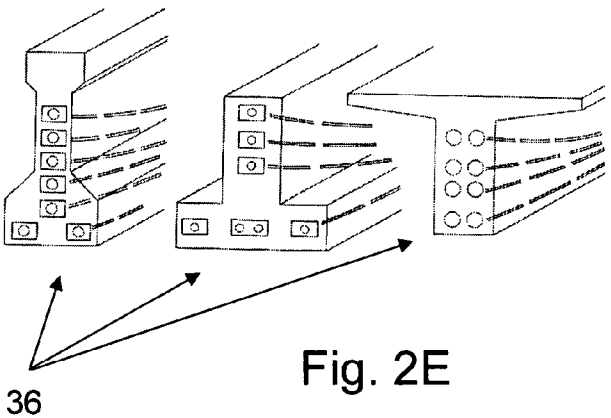
Fig. 2E
Fig. 2

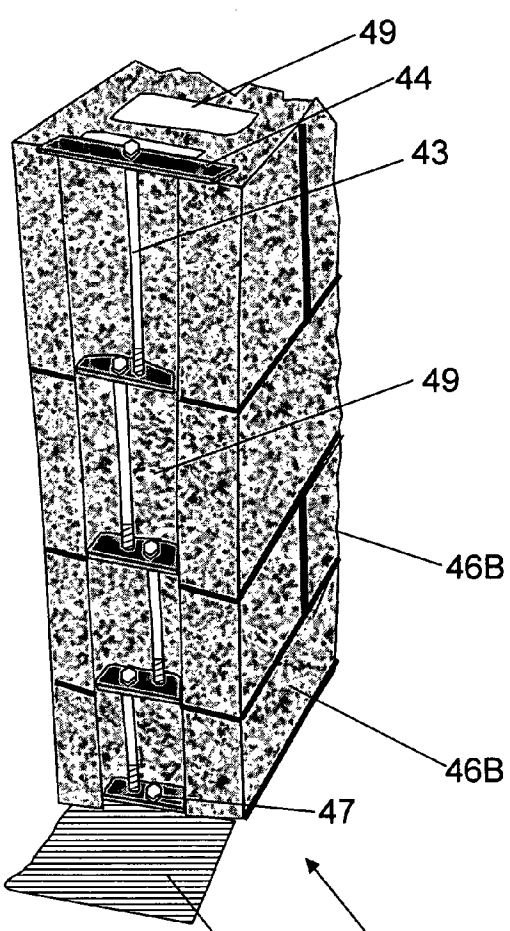
Fig. 5B
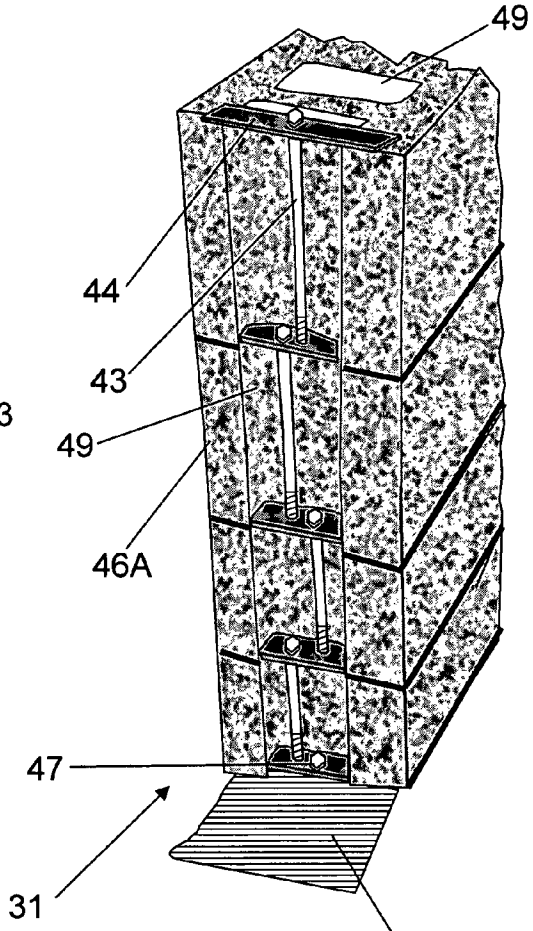
Fig. 5A
Fig. 5
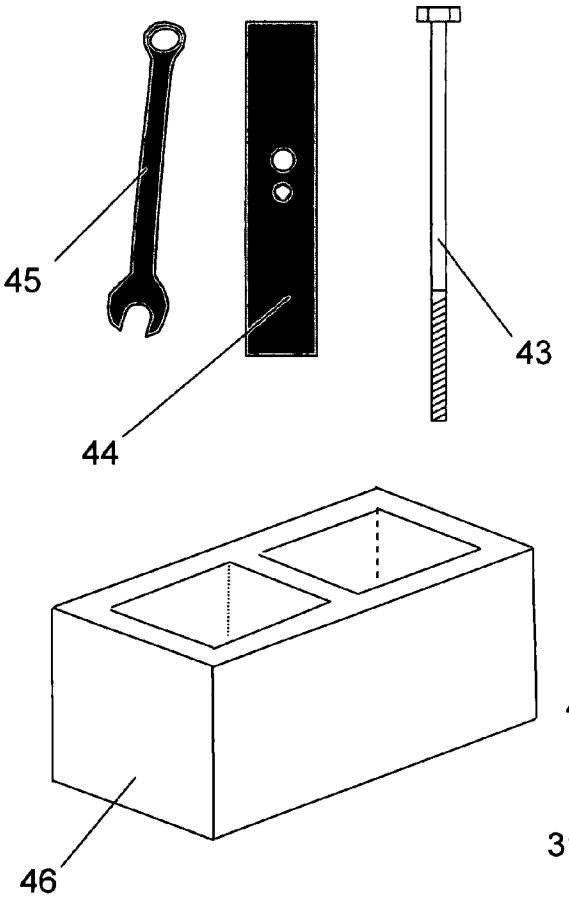
Fig. 4

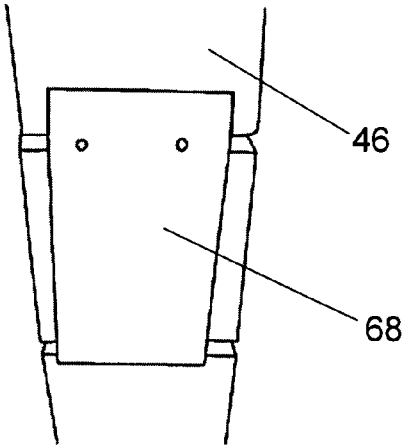
Fig. 10C
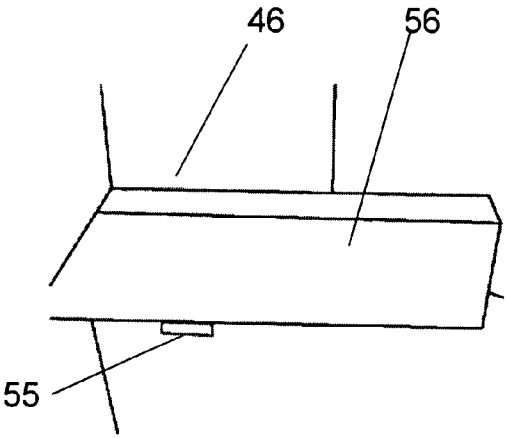
Fig. 10B
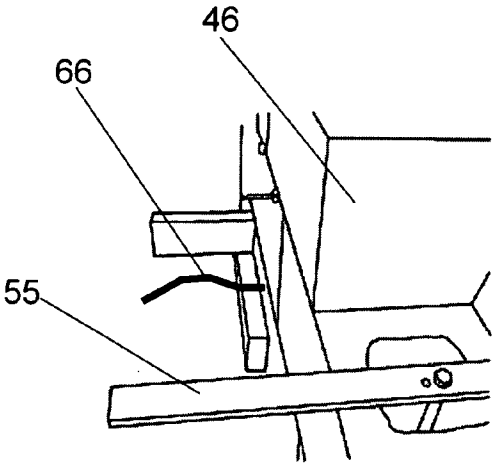
Fig. 10A
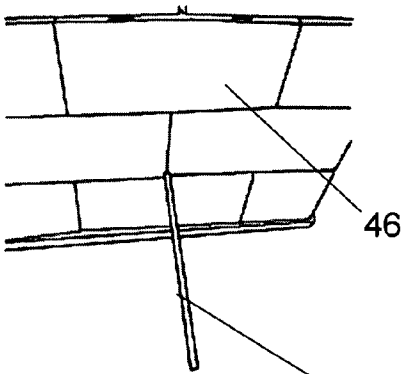
Fig. 10G
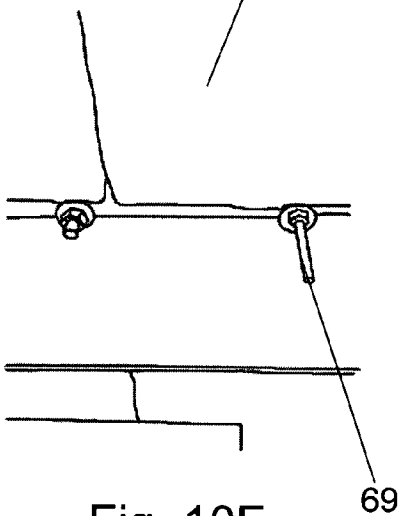
Fig. 10F
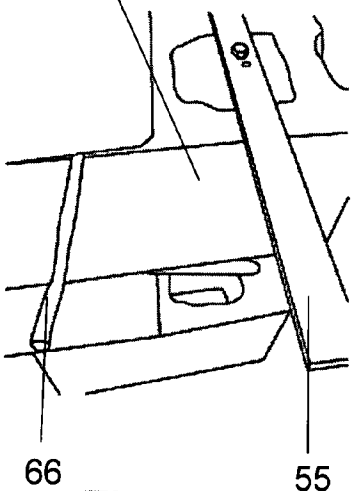
Fig. 10E
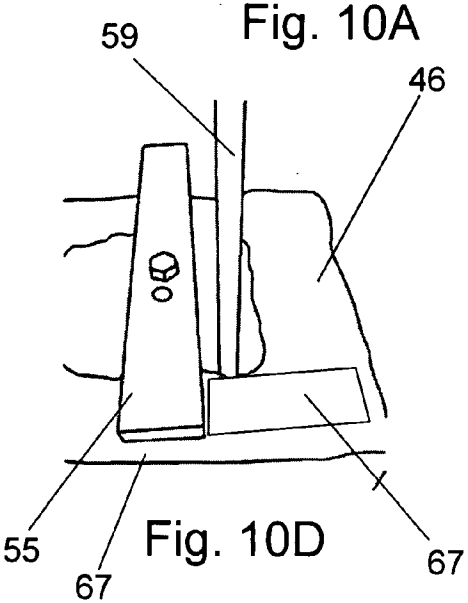
Fig. 10D
Fig. 10

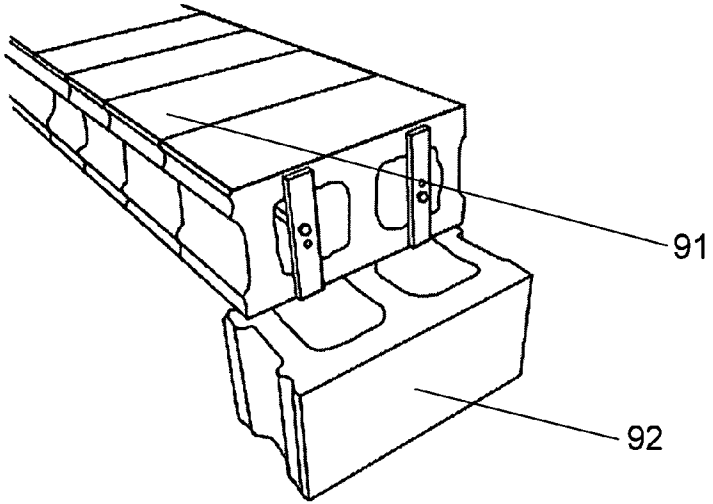
Fig. 12A
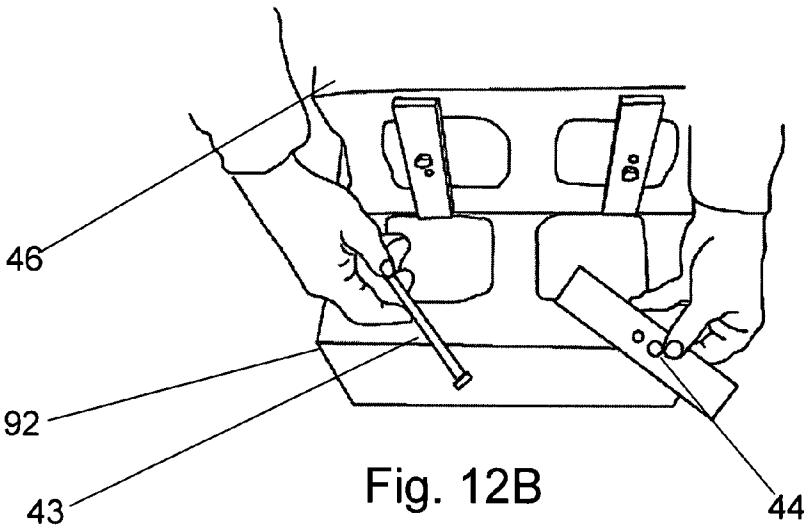
Fig. 12B
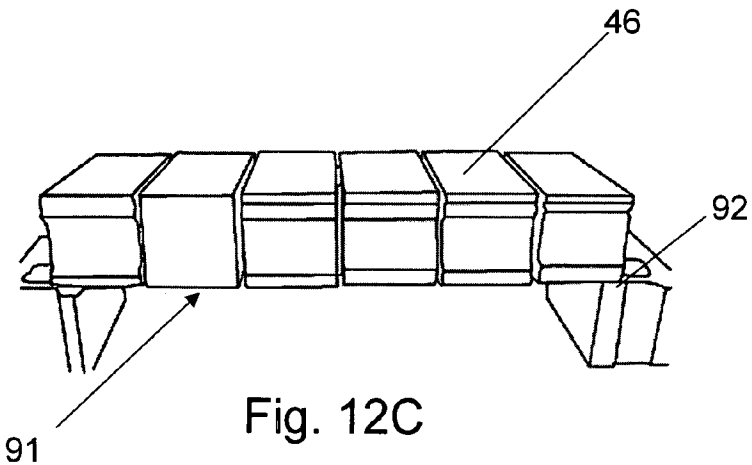
Fig. 12C
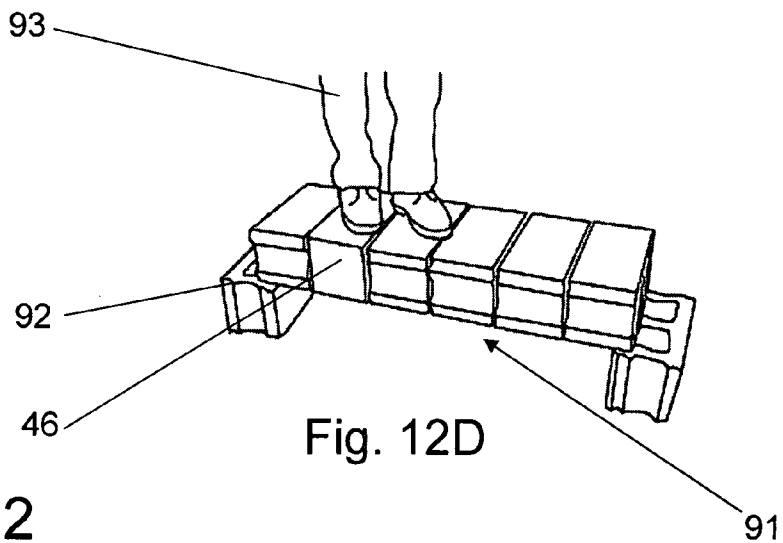
Fig. 12D
Fig. 12

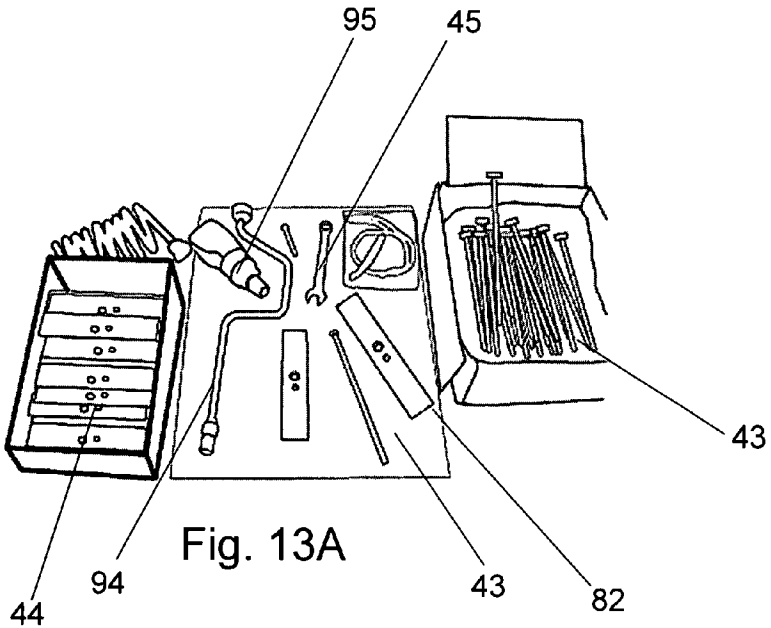
Fig. 13A
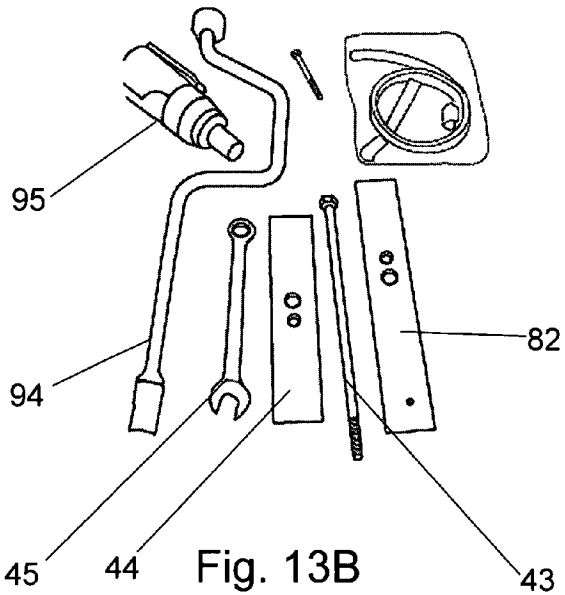
Fig. 13B
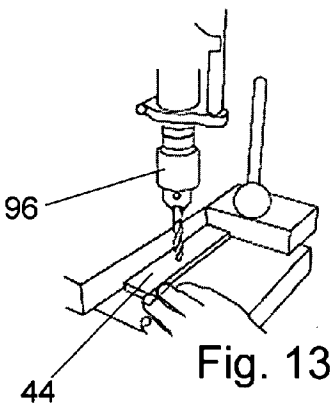
Fig. 13C
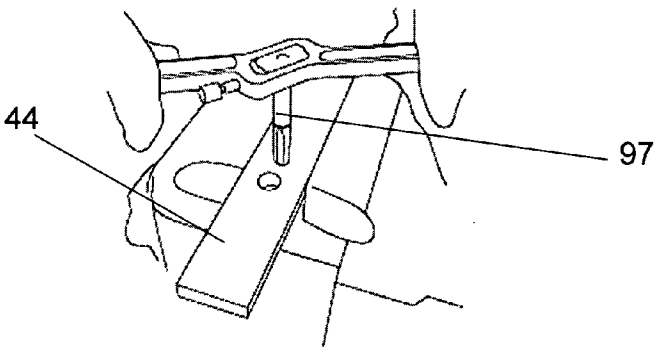
Fig. 13D
Fig. 13

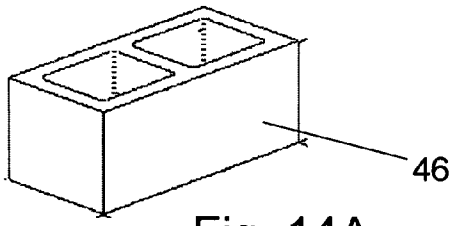
Fig. 14A
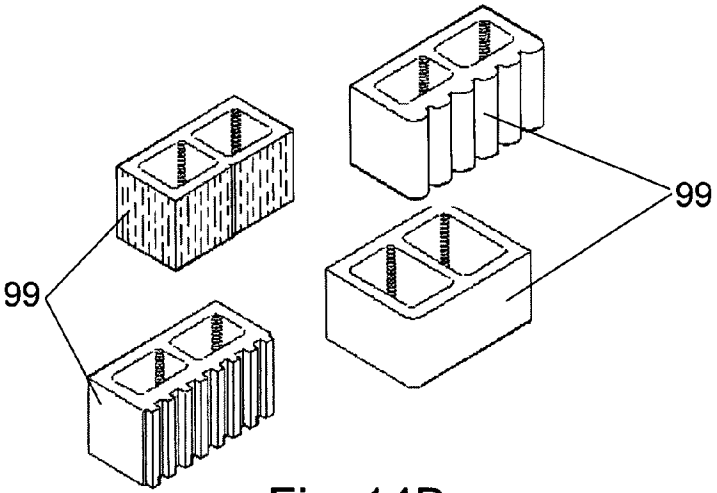
Fig. 14B
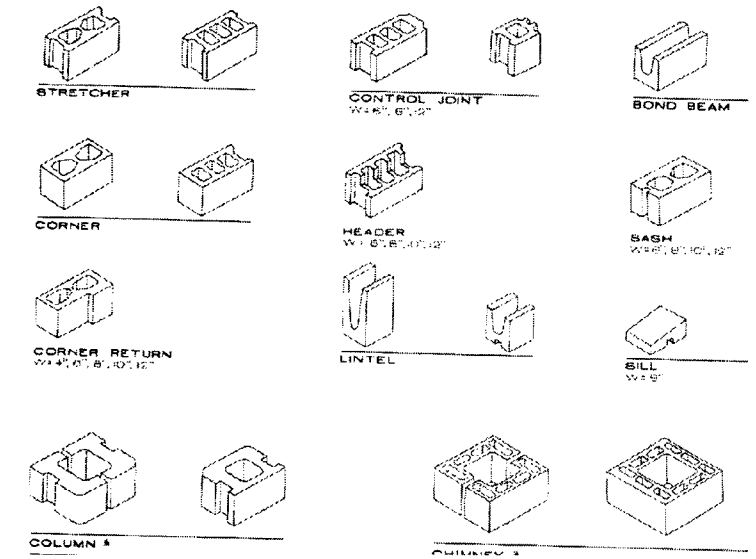
Fig. 14C
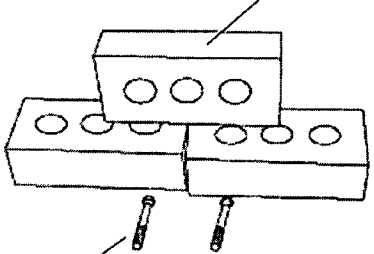
Fig. 14E
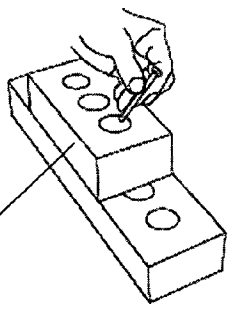
Fig. 14D
Fig. 14

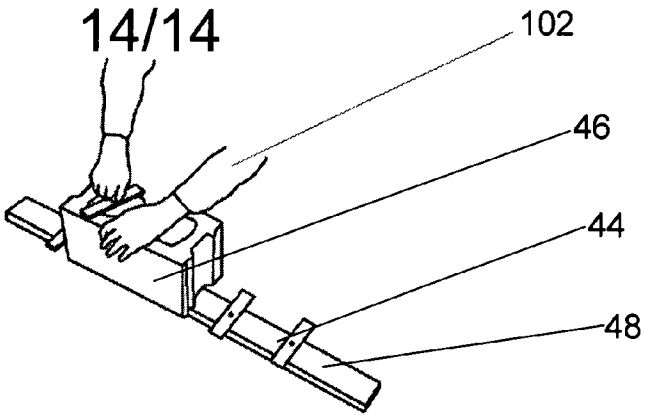
Fig. 15A
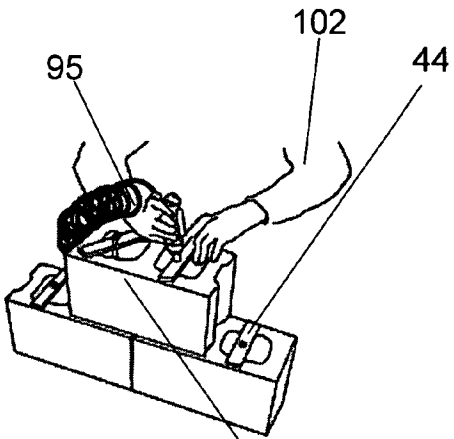
Fig. 15C
Fig. 15
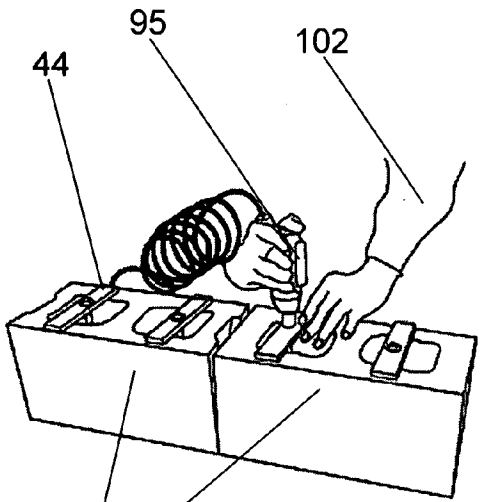
Fig. 15B

SYSTEMS FOR BUILDING CONSTRUCTION BY ATTACHING BLOCKS WITH BOLTS AND VERTICALLY SPACED FLAT BARS

CROSS-REFERENCE TO RELATED APPLICATIONS

Not Applicable

FIELD OF INVENTION

This invention relates to a unitized masonry structure, particularly structures with post tensioned reinforcement. The present invention relates generally to all general construction where a common mortar and hollow block or brick combination is utilized and to other construction means for structures as well.

FEDERALLY SPONSORED RESEARCH

Not Applicable.

SEQUENCE LISTING OR PROGRAM

Not Applicable.

BACKGROUND

Field of Invention

The new unitized masonry structure described in this specification is a construction system that is designed to easily and quickly install in any location without the need for mortar, water, or power. In the United States alone there are over 4000 block manufacturing companies. Traditionally, building blocks and bricks are attached to each other by either of two methods. The first is by gravity, which includes stacking, arches, and flying buttresses. The second is by mortar and mortar equivalent methods, such as various types of mortar, epoxy, or blocks having their cores concrete filled, with or without reinforcing steel bars (rebars). This attachment includes mortar with reinforcing wire in the joints and also includes attachment between masonry units with concrete and rebars in such shapes as bond beam blocks and pier blocks.

Normally when reinforcement means have been used with block, it is accomplished with either long rebars or long steel rods placed in the cavities. Post tensioning has only been used with a complete stack of block in conjunction with the mortar between each layer. Specialty block systems with rods and plates require complex design and skill.

A. Introduction of the Problems Addressed

Since most masonry structures use mortar, several things are required. First, the mortar requires water. Second, in most cases, the laying of block requires a skilled block or brick mason. Third, a means of power to mix the mortar is normal. Fourth, elaborate bracing 38 and reinforcement is needed until the mortar cures and reaches its strength (FIG. 3B). The overall structure is "fragile" to wind, severe temperatures, and other natural weather and environmental conditions. During this time, occupation and use of the structure is unwise. Also, scaffolding 37 often remains in place awaiting cure before additional blocks are added (FIG. 3A). If proper preparation and care are not provided to reduce the environmental impacts, the mortar and overall structure may result in cracking and diminished structural strength. Reinforcing means 35 are often provided to improve strength (FIG. 2D), but the need to have bracing and other protection in place for many days and weeks is still needed. Finally, once built, the traditional masonry systems become a fixed structure. Unless very special provisions are added to the normal block, rebar and mortar system, the structure is not re-useable and must be "demolished" to be removed.

These stated requirements each limit the use of the traditional masonry with mortar system. The Bolt-A-Blok system facilitates a clear improvement to traditional construction systems and their limitations. Accordingly, it would be advantageous to have a system that does not require special skills to construct; does not need water and power; does not require elaborate bracing; is useable immediately and needs no curing time; and, is re-useable if desired and is not destroyed when disassemble and moved. This improvement would decrease the time to build or rebuild areas and would minimize the restriction of skilled labor. Importantly without the bracing and exposure to weakening by disturbing the mortar, the Bolt-A-Blok system provides a far superior and more consistent strength to the mortar constructed structure.

B. Prior Art

Historically, few patented devices have attempted to address the problem as stated. The building industry has made little progress for a unitized, post tension system. Even so, blocks have required special configurations to even handle rods and plates and then the have taught only limit rods in special blocks. One such device is described in U.S. Pat. No. 5,511,902 (1996) issued to Center which teaches an Instant levy block system. This is a complex, specially made block for constructing a levy, comprising a plurality of blocks, a plurality of connecting pegs, and a plurality of stakes. Each part is uniquely designed and made whereas the Bolt-A-Blok system utilized standard, readily available components.

Another block device is described in A U.S. Pat. No. 5,809,732 which was issued to Farmer, Sr. et al (1998) which teaches a masonry block with an imbedded plate. The concrete masonry block has an external plate or plates that are anchored through the concrete masonry block. The external plates are cast into the concrete masonry block in the mold during casting. These are not regular hollow core blocks available globally as used with the Bolt-A-Blok system.

Another device for construction is taught by U.S. Pat. No. 6,098,357 issued to Franklin et al. (2000). This art discloses a modular pre-cast construction block system with a wall subsystem and a foundation subsystem. The wall subsystem has a number of wall units having cavities and pre-stressed tension cables are cast therein the cavity. This teaches precast walls and through cable which are special made, require water, and are not readily re-useable like the Bolt-A-Blok system.

A re-useable system 32 is taught in the U.S. Pat. No. 6,178,714 issued to Carney, Jr. (2001) (FIGS. 2A and 2B). The rods go through apertures in the special block and the precast structures. The configuration of special length rods, special blocks, special plates and a complex system that requires powered equipment to construct is unlike the simple, available components of the Bolt-A-Blok system.

A mortarless wall structure is taught in U.S. Pat. No. 6,691,471 issued to Price (2004). Here a wall structure comprising of columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses.

Traditional masonry structures which use mortar have several characteristics which merit brief discussion as prior art. Most are constructed such that the roof structure 34, 39 is attached to a top plate which is anchored by bolts into the hollow cavities (FIG. 2C and FIG. 3C). The corners 40 and straight sections 41 often are staggered and have wire mesh and an occasional rebar (FIGS. 3 D and E). Finally, openings for doors and windows are often breached by pre-cast lintels 42 (FIG. 3F).

Other prior art applicable to a thorough understanding of the significant technological advantages and improvements offered by the Bolt-A-Blok system need some discussion of the post tensioning technology used in construction today. Simply put, Post-Tensioning is a method of reinforcing concrete, masonry, and other structural elements. Post-tensioning is still state-of-the-art engineering, but until now it has only been possible to attach multiple concrete units directly to each other with rods and cables. The Bolt-A-Blok system makes possible the post-tensioning of a single masonry unit in a manner that makes it possible to attach additional single post-tensioned masonry units while at the same time combining and maintaining the post-tensioning of all the units.

Traditional post-tensioned units 36 may have various configurations (FIG. 2E). To date this technology has been unobvious as being applied at a unitized configuration. Individual blocks are attached to each other and now, as a new combination, perform as if it were all one post-tensioned beam, bridge, wall, or structure. This Bolt-A-Blok system works equally well with all size masonry units.

Traditional Post-Tensioned reinforcing consists of very high strength steel strands or bars. Typically, strands are used in horizontal applications like foundations, slabs, beams, and bridges; and bars are used in vertical applications like walls and columns. A typical steel strand used for post-tensioning has a tensile strength of 270,000 pounds per square inch. This actually teaches against the Bolt-A-Blok system use of individual, standard bolts and simple fasteners. Post-tensioning using plates, or bars, between the masonry units is a totally new way of combining steel and concrete and is sound engineering practice.

None of the prior art teaches all the features and capabilities of the Bolt-A-Blok system. As far as known, there are no systems at the present time which fully meet the need for a unitized, post-tensioned masonry block structure as well as the Bolt-A-Blok system. It is believed that this system is made with standard parts, is built with simple tools, needs no mortar, provides a much stronger structure than mortar structures, and is ready for immediate use and occupation upon construction.

SUMMARY OF THE INVENTION

A Bolt-A-Blok system has been developed for use in constructing various types of structures. Bolt-A-Blok system is a building system that demountably couples each individual hollow cored block or brick by use of a bar and bolt system. This coupling results in stronger, faster, and cheaper construction of buildings. While the three main components—a bar, a bolt and a block—are securely connected, the means of attachment is capable of full disassembly if desired. The Bolt-A-Blok system can be accomplished by unskilled persons with a simple wrench. There is no need for water, no special tools (a simple wrench will suffice), no bracing, and the structure made by the Bolt-A-Blok system is ready for immediate use. The newly invented Bolt-A-Blok system features readily available hollow core masonry units with a fastener (bolt) and a plate.

OBJECTS, ADVANTAGES AND BENEFITS

There are many, many benefits and advantages of the Bolt-A-Blok system. There currently exist no construction systems that use readily availably parts and are so easy to perform. However, by having the unitized post tensioning technology, the structure is a far stronger unit than one built by traditional mortar-using techniques. See TABLE A for the list of advantages and benefits.

TABLE A

ADVANTAGES AND BENEFITS

| ITEM | DESCRIPTION |
|---|---|
| 1 | Is Waterless |
| 2 | Requires no wait time to get structural strength |
| 3 | Requires no temporary support while mortar cures and gains strength |
| 4 | Uses simple hand tools |
| 5 | Is Useful with/without footer |
| 6 | Has greater final tensile and compressive strength than mortar construction - is much stronger |
| 7 | Is Environmental friendly - Uses less wood, hence there is less deforestation required to support construction |
| 8 | Has a reasonable total cost - material and unskilled labor |
| 9 | Permits rapid build. |
| 10 | Can be easily disassemble and components re-used. |
| 11 | Does not require skilled labor |
| 12 | Has Global/worldwide/universal applications |
| 13 | Uses Existing, standard materials |
| 14 | Can be built on soil or standard foundation |
| 15 | Spans greater distances between vertical double blocks |
| 16 | Uses standard product available throughout the globe in all countries |
| 17 | Is easy to learn the build concept and start building with non-skilled workers. With this easy learning curve, it is simple to learn and simple to use. So simple that multiple workers may be in the same area - not "laying" block but assembling a structure |
| 18 | Provides perfect spacing which means more attractive walls. Blocks have perfect alignment and correct placement before tightening |
| 19 | Reduces fire insurance and wind insurance costs |
| 20 | Uses existing modular sizes, worldwide. |
| 21 | Is an all weather construction. All kinds of weather, rain, snow, wind, cold, hot, underwater, even in a diving bell or caisson |
| 22 | Is a Unitized construction. If one stops or anything interrupts the build at any point, one can resume immediately without the former problems of mortar drying out and the other messy problems. |
| 23 | May provide Electrical grounding through metal bars |
| 24 | Provides many additional methods to attach materials using the joint spaces - such as through bolts, carriage bolts, and toggle bolts for adding of bolts. There is no hole drilling in blocks needed. |
| 25 | May build a wall by working from either side. Inside or outside. |
| 26 | Works with one or more core block, brick, and other building units |
| 27 | Requires less scaffolding, ladder jacks and walk boards because the walls are immediately at full strength. |
| 28 | Permits electrical wire and cable (such as Romex ™ to go through the intermediate spaces and may fasten external boxes or recess in drywall, etc, |
| 29 | Can pour concrete in cores and even add vertical rebar's. |
| 30 | Can pour insulation or spray foam in cores. |
| 31 | Resists flying debris. |
| 32 | Resists Earthquake and Hurricane/tornado. |
| 33 | Is fire resistant. |
| 34 | Is not dependent on mortar strength |
| 35 | Requires no power or gasoline to build |

TABLE A-continued

| ADVANTAGES AND BENEFITS | |
|---|---|
| ITEM | DESCRIPTION |
| 36 | Uses with standard block, worldwide |
| 37 | Is useable with other construction techniques - door and window frames, roof and ceiling joists and trusses; metal and asphalt/fiber/rubber ?? roofing; |
| 38 | Is useable with standard plumbing, electrical, communications and lighting packages |
| 39 | Has the ability to construct several block layers at one time - speeds overall construction |
| 40 | Adapts to regular interior (plaster, boars, panel, paint) and exterior wall surfaces (siding, brick, stucco, etc) |
| 41 | Provides perfect plumb and level alignment |
| 42 | Does not require poured foundations |
| 43 | Is a Unit by unit construction |
| 44 | The simple bar and bolt is easily mass produced using existing materials and equipment. |
| 45 | Is possible for the builder to leave out a small portion of the foundation wall so that trucks and backhoes can easily cross into the structure to grade, spread stone, unload concrete or do whatever is necessary. As soon as the heavy inside work is completed, the wall is quickly bolted into place and is ready to go, at full strength. |
| 46 | Provides a mass is so strong, and the total weight of a Bolt-A-Blok system building is of such significant weight, that below ground freezing may largely only push sideways. |
| 47 | May be combined with a pre-constructed bath and/or kitchen unit. |
| 48 | Is termite and carpenter aunt proof. |

For one skilled in the art of construction of structures, especially masonry, concrete, and steel structures, it is readily understood that the features shown in the examples with this system are readily adapted to other types of construction improvements.

DESCRIPTION OF THE DRAWINGS

Figures

The accompanying drawings, which are incorporated in and constitute a part of this specification, illustrate an embodiment of the Bolt-A-Blok system that is preferred. The drawings together with the summary description given above and a detailed description given below serve to explain the principles of the Bolt-A-Blok system. It is understood, however, that the Bolt-A-Blok system is not limited to only the precise arrangements and instrumentalities shown.

FIGS. 2 A through 2 E are sketches of prior art for masonry and post tensioned structures.

FIG. 4 are sketches of the main components for Bolt-A-Blok system, namely blocks, bars, fasteners and a wrench.

FIGS. 5 including 5 A and 5 B are Bolt-A-Blok systems that show the specific parts and characteristics of the system.

FIGS. 10 A through 10 G provide photographs of attachment devices which are examples shown with the Bolt-A-Blok system prototype wall.

FIGS. 12 A through 12 D show sketches of a possible deck structures made by the Bolt-A-Blok system.

FIGS. 13 A through 13 D show photographs of tools used in the original prototype of Bolt-A-Blok system.

FIGS. 14 A through 14 E show sketches of typical hollow core masonry blocks and bricks useful when utilized with the Bolt-A-Blok system.

FIGS. 15 A through 15 C show photographs of a construction process using the Bolt-A-Blok system.

REFERENCE NUMERALS

Figure 1:
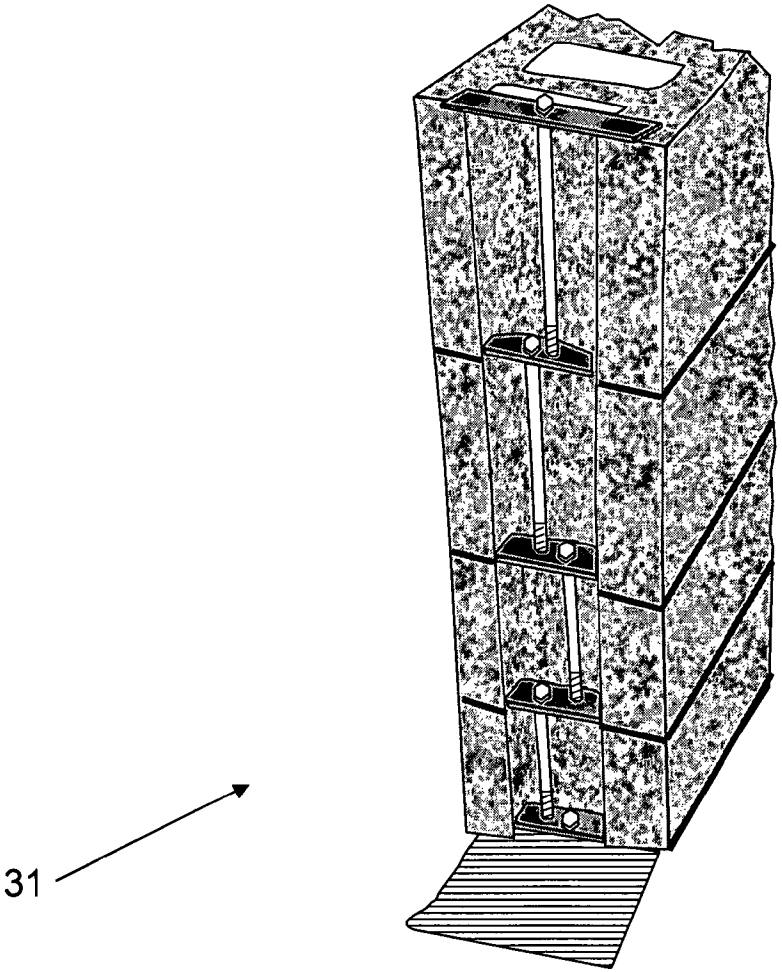
FIG. 1 is a sketch of the general Bolt-A-Blok system.

The following list refers to the drawings:

| | |
|---|---|
| 31 | general assembly of the Bolt A Blok - stacked soldier configuration |
| 31A | general assembly of the Bolt A Blok - stacked running or offset configuration |
| 32 | prior art special block and through rods |
| 34 | prior art wood truss on block system |
| 35 | prior art rebar in block system |
| 36 | prior art post tension cables in concrete |
| 37 | typical scaffolding and wall build for "mortar" masonry systems |
| 38 | typical temporary bracing for water and mortar systems |
| 39 | typical mortar and block wall cross section |
| 40 | typical mortar and block wall corner |
| 41 | typical mortar and block wall section |
| 42 | typical mortar and block window and door lintels |
| 43 | fastener (bolt) |
| 44 | bar |
| 45 | tool (wrench) |
| 46 | hollow core block - typical |
| 46A | hollow core block - stacked soldier configuration |
| 46B | hollow core block - stacked running or offset configuration |
| 47 | starter fastener |
| 48 | base means device (foundation, board, plate, etc.) |
| 49 | masonry block cavity |
| 49A | space between adjacent block (46) |
| 50 | clear aperture through bar (44) |
| 51 | threaded aperture through bar (44) |
| 52 | prototype stacked bolt a blok system |
| 53 | bar and bolt system with blocks removed |
| 54 | prototype wall assembly |
| 55 | extended bar |
| 56 | beam on extended bar |
| 57 | insulation matter between block (46) |
| 58 | siding and insulation panel (interior or exterior) |
| 59 | pipe interior to block cavity (49) |
| 60 | top plate for truss support |
| 61 | roof joist/truss system |
| 62 | plastic sheet vinyl such as (Visqueen ™ or Tyvek ™) |
| 63 | furring strip for mounting panels, gyp board, etc. |
| 64 | extended tie rod or bar |
| 65 | means to attach (truss to wall) such as a band clamp |
| 66 | electrical wiring |
| 67 | stabilizing shim |
| 68 | door jamb |
| 69 | wall mounting fastener |
| 70 | earthwork near foundations |
| 71 | foundation concrete |
| 72 | non linear or irregular block configuration |
| 73 | radii block for curved configurations |
| 74 | general lintel application |
| 75 | door or window perimeter |
| 76 | soldier block for lintel |
| 77 | door or window aperture |
| 78 | standard two hole bar |
| 79 | "H" bar for joining block |
| 80 | "Double H" for high strength applications |
| 81 | lintel plate and connector |

-continued

| | |
|---|---|
| 82 | double extended bar |
| 83 | turning bar for corners and nonlinear connections |
| 84 | connector bar |
| 85 | double row bar |
| 86 | base plate bar |
| 87 | winged base plate bar - metal or non-metal |
| 88 | door frame connection configuration |
| 89 | brick bar |
| 90 | tee-handle connector or fastener |
| 91 | lateral deck configuration |
| 92 | deck support |
| 93 | deck load - people or equipment, etc. |
| 94 | hand socket driver |
| 95 | powered impact driver |
| 96 | means to manufacture through hole/aperture in bar (44) |
| 97 | means to manufacture threads in the bar (440 to receive the fastener (43) |
| 98 | typical hollow cavity block |
| 99 | ornamental or decorative hollow core block |
| 100 | hollow core brick |
| 101 | fasteners for brick |
| 102 | non-skilled worker assembling the system |

DETAILED DESCRIPTION OF PREFERRED EMBODIMENT

The present device is construction system called a Bolt-A-Blok system 31. This system is comprised of only a few different types of components—a hollow core block 46, fastener (such as a through bolt) 43, and a simple bar 44 with some additional features. The system configures the adjacent block 46 and demountably couples the blocks by means of the bolts 43 and bars 44. This coupling results in a structure that is formed from a plurality of unitized, post tensioned blocks or bricks that collectively are far stronger than an ordinary block structure built with mortar and standard reinforcing. A person having ordinary skill in the field of construction, especially with reinforced masonry structures, appreciates the various parts that may be used to physically permit this Bolt-A-Blok system 31 to be produced and utilized. The improvement over the existing art is providing a construction system that has many advantages and benefits as stated in the previous section entitled Objects, Advantages, and Benefits.

There is shown in FIG. 1 and FIGS. 4 through 15 a complete operative embodiment of the Bolt-A-Blok system 31. In the drawings and illustrations, note well that the FIG. 1 and FIGS. 4 through 15 demonstrate the general configuration of this invention. The preferred embodiment of the system is comprised of only a few parts as shown. Various important features of these components are delineated in FIG. 1 and FIGS. 4 through 15 of the drawings and are described below in appropriate detail for one skilled in the art to appreciate their importance and functionality to the Bolt-A-Blok system 31.

The accompanying drawings, which are incorporated in and constitute a part of this specification, illustrate an embodiment of the Bolt-A-Blok system 31 that is preferred. The drawings together with the summary description given above and a detailed description given below serve to explain the principles of the Bolt-A-Blok system 31. It is understood, however, that the Bolt-A-Blok system 31 is not limited to only the precise arrangements and instrumentalities shown.

Figures 3, 3A, 3B, 3C, 3D, 3E, 3F:
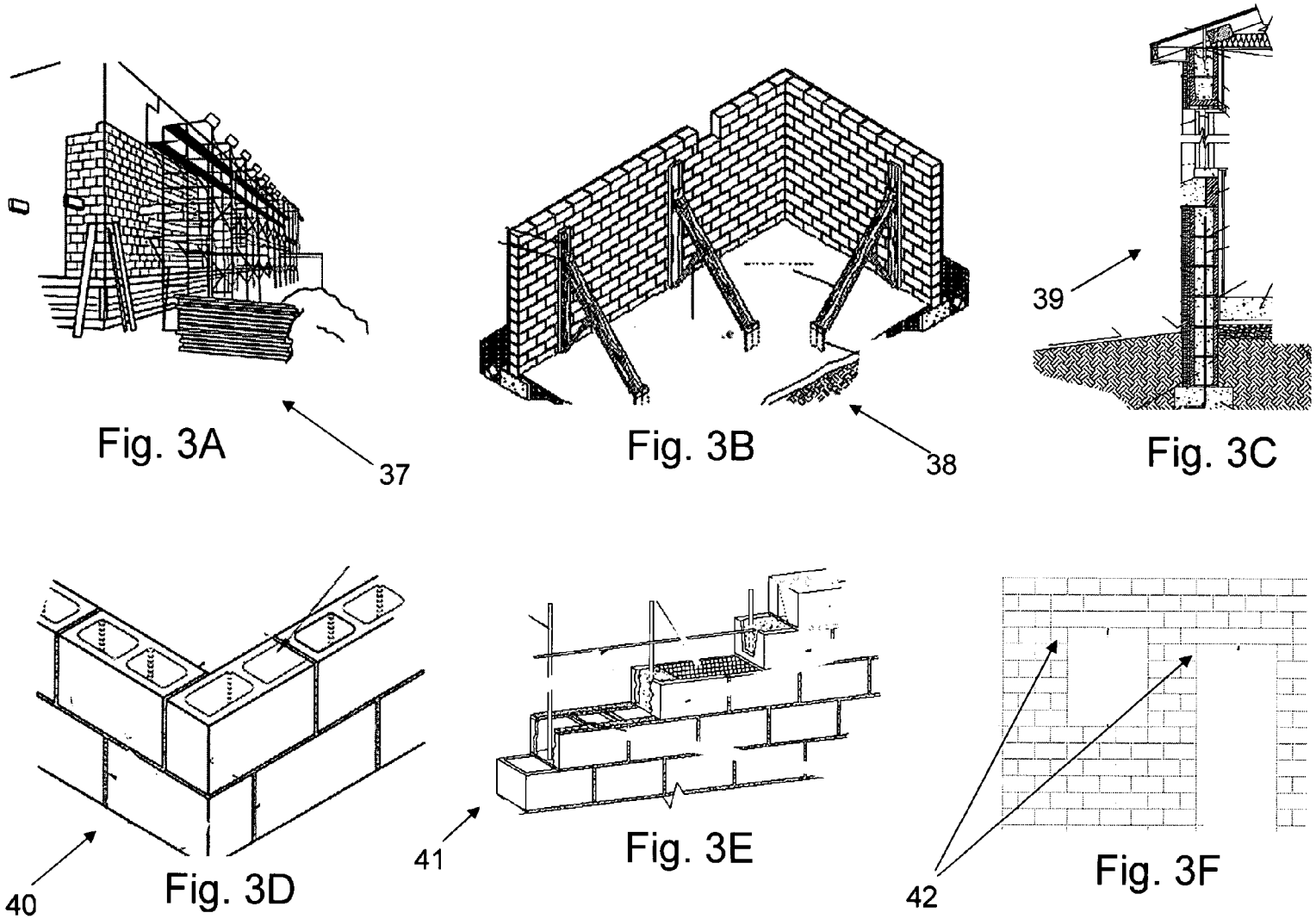
FIGS. 3 A through 3 F are additional prior art depictions.

FIG. 1 is a sketch of the general Bolt-A-Blok system 31. One should note that FIGS. 2 A through 2 E are sketches of prior art for masonry and post tensioned structures. Also a person should note that FIGS. 3 A through 3 F are additional prior art depictions. These are discussed in the prior art section above. However, a knowledge of those prior configurations and building methods serve an important background for one skilled in the art to fully appreciate the unique characteristics provided by the Bolt-A-Blok system 31. For many decades, and in fact a full century, masons and builders, architects and engineers, have had hollow masonry blocks and bricks to use. Likewise, steel bars and various fasteners have been readily available. However, no one taught or developed this unique, simple combination as an obvious extension of the construction technology.

In FIG. 4 are sketches of the main components for using and creating structures with the Bolt-A-Blok system 31, namely blocks 46, bars 44, fasteners 43 and a tool 45 (such as an open ended wrench).

FIG. 5 including 5 A and 5 B are Bolt-A-Blok systems 31 and 31A that show the specific parts and characteristics of the system. Note there is a series of typical blocks 46 stacked as a soldier configuration 46A or stacked in a staggered/overlap configuration 46B. In either case, the structure "extends" through the hollow cavities 49 of the blocks 46. The system consists of a bar 44 placed at the base on top of the base means 48 (a board, a foundation, rock or firm ground, etc). The lowermost bar 44 is secured by a starter fastener 47 such as a short bolt, a spike, a concrete anchor or the like. Then the through fasteners 43 alternate locations and extend through an open aperture 50 (not shown) and are removably connected to the lower bar 44 by means of the threaded aperture 51 (not shown). A plurality of bars 44 and fasteners 43 continue to build upward with each layer or course of the masonry block 46. On the top block 46 the last fastener is placed and the demountable coupling of the blocks 46 is complete.

Figures 6, 6A, 6B, 6C, 6D, 6E, 6F, 6G:
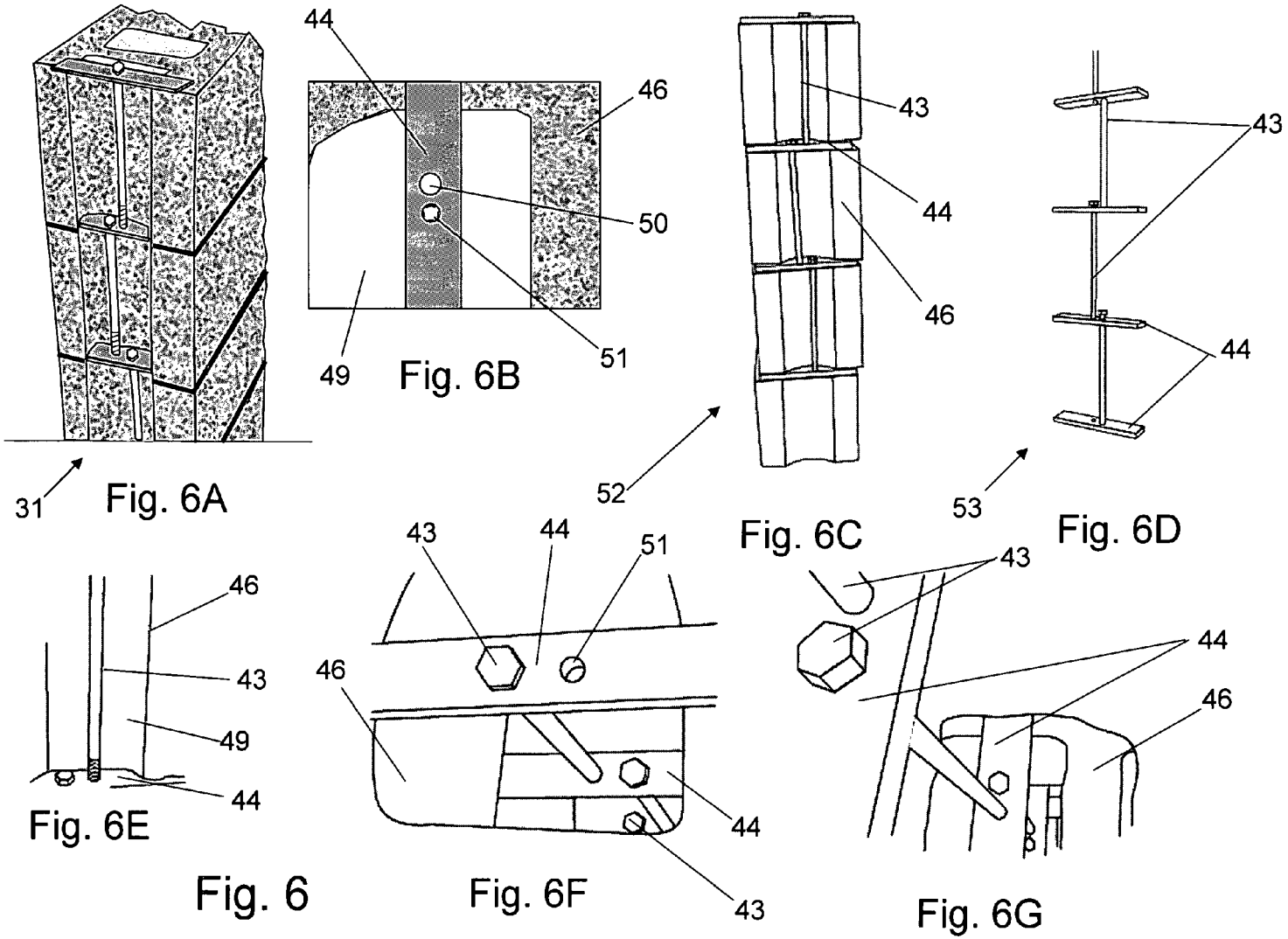
FIGS. 6 A through 6 G provide details of the Bolt-A-Blok system with detailed sketches and photographs of prototype structures.

FIGS. 6 A through 6 G provide details of the Bolt-A-Blok system with sketches of prototype structures. FIG. 6 A repeats the general Bolt-A-Blok system 31 for easy reference. FIG. 6 b is a top drawing that highlights the free and open aperture 50 and the threaded aperture 51 in the bar 44. Note the placement over the block 46 in the location of the hollow cavity 49. The bar 44 materials may be of various metals including but not limited to steels, iron, aluminum, and the like, etc. or from composite materials such as plastics, fiberglass and other rigid materials that will permit the fasteners 43 to be torqued to sufficient pressure to hold the block 46 rigidly in place. Likewise, depending on the material and process used to create the bar 44, there are various means of producing the through aperture 50 and threaded aperture 51 such as, for example and not as a limitation, drilling, tapping, rolling, casting, etc. FIG. 6 E shows an illustration of a prototype Bolt-A-Blok system 52. FIG. 6 D is an illustration of the bar 44 and fastener 43 system with the blocks 46 removed. FIG. 6E is an illustration of the cross section of a single cavity 49 with the bar 44 and fastener (bolt) 43. FIGS. 6 F and G are top view illustrations of the prototype Bolt-A-Blok system 52 looking down into the cavity 49.

Figures 7, 7A, 7B, 7C:
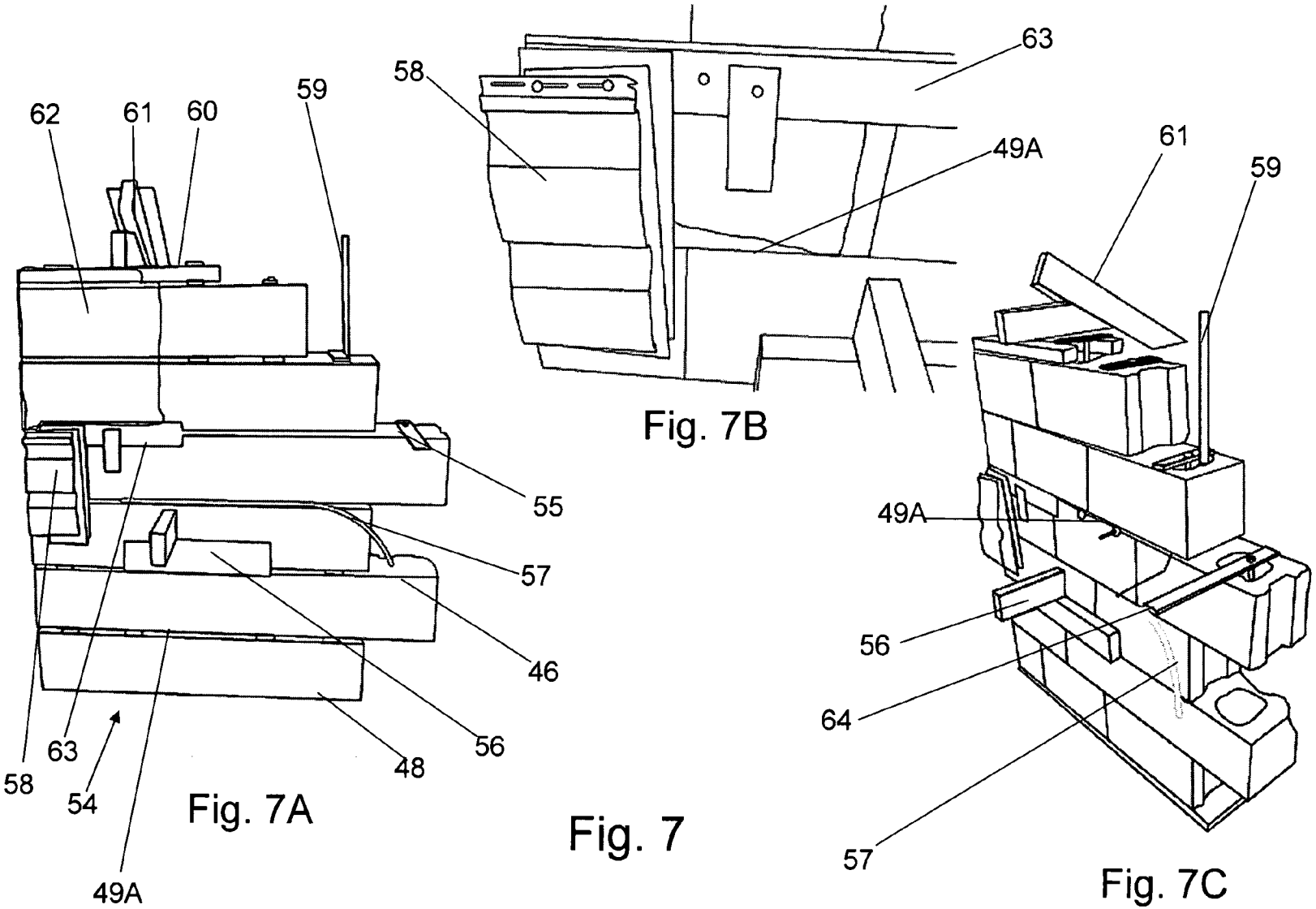
FIGS. 7 A through 7 C show the details of the Bolt-A-Blok system and several of the features that may accompany the system.

FIGS. 7 A through 7 C show the details of the Bolt-A-Blok system 31 and several of the features and components that may accompany the system in a structure such as a building wall. FIG. 7 A is an illustration of the prototype wall assembly 54. Here a base means 48 is a simple board on top of a concrete slab. The blocks 46 are in a staggered configuration but a soldier stack would also work. In between the adjacent blocks FIG. 6 A is a very small space 49A created by the separation of blocks 46 caused by the location of the bars 44. This space 49A permits many features and components to be used with the Bolt-A-Blok system 31. For example, this illustration shows insulation matter 57 in the space 49A between the block 46. Also, the space 49A allows for extended bars 55 to protrude beyond the face of the block 46. This has helpful characteristics such as permitting a beam 56 to mount in the extended bar 55. Furring strips 63 may be placed and attached in the space 49A to permit panels 58 and wallboard or the like to be attached to the wall 54 on the interior or exterior surface. On the uppermost course of block 46, a top plate 60 may be installed. This will then receive a roof truss 61 or ceiling joists. Finally shown as one of the various other features a wall 54 like this permits is a layer of plastic 62 to aid in wind infiltration and heating or cooling the structure. FIG. 7 B is a close-up illustration of the wall 54 showing a better view of the furring strip 63 and the panel 58. FIG. 7 C is a perspective illustration of the wall 54 giving a clearer view of the beam 56 and the truss 61. Also one notes the potential for plumbing pipes 59 to be placed inside the cavity 49. One notes the extended tie rod 64 near the base that demonstrates the ability to connect the lower portion of a wall using the Bolt-A-Blok system 31 to an adjoining structure or other portion of a foundation.

Figures 8, 8A, 8B, 8C, 8D:
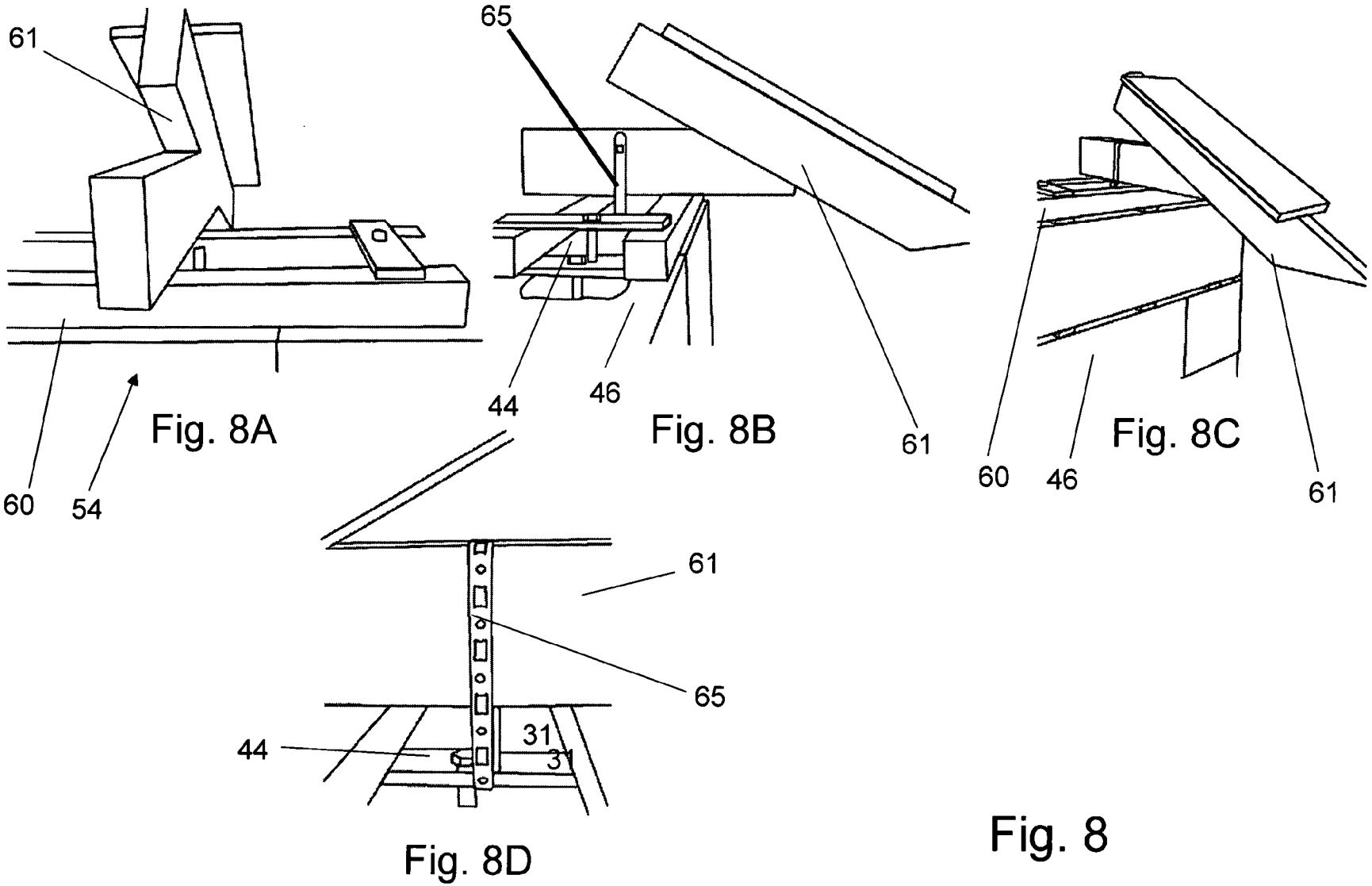
FIGS. 8A through 8 D are Photograph of a method to securely attach a roof structure to the Bolt-A-Blok system wall.

FIGS. 8A through 8 D are several illustrations from different perspectives that demonstrate a method to securely attach a roof structure 61 to the Bolt-A-Blok system 31 wall 54. The top plate 60 rests on the upper surface of the block 46. The roof truss or joist structure 61 is contiguous to and in contact with the top of the top late 60. There is a means to attach 65 the truss 61 to the block 46. Here the means 65 is a steel clamp surrounding the truss 61 and securely connecting the truss 61. This security is accomplished by having the steel clamp 65 being interposed into the hollow cavity 49 and surrounding a secured bar 44, thereby rigidly and removably connecting the truss 61 to the bar 44 and hence the wall 54.

Figures 9, 9A, 9B, 9C, 9D, 9E:
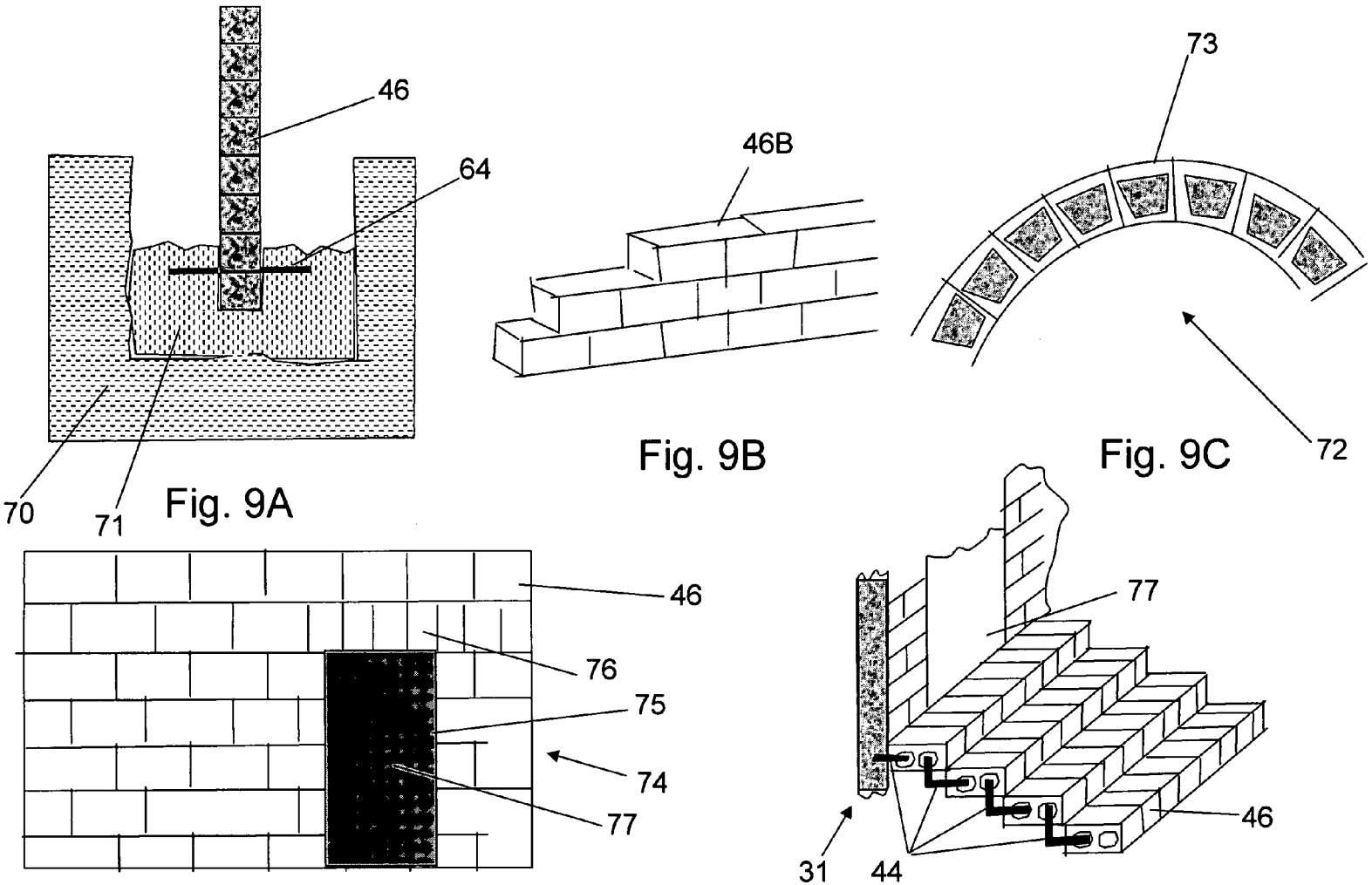
FIGS. 9 A through 9 E show sketches of possible structures made by the Bolt-A-Blok system.

FIGS. 9 A through 9 E show sketches of possible structures made by the Bolt-A-Blok system 31. In FIG. 9A, a wall made of blocks 46 is placed interior to an earthwork 70 and surrounded by a concrete foundation 71. One notes the extended tie rods or bars 64 (one or more) for securing and attaching the Bolt-A-Blok system 31 wall to the foundation. In FIG. 9B a series of courses of staggered blocks 46B is demonstrated. In FIG. 9C a non-linear or irregular shaped structure 73 is demonstrated. Here the individual blocks 72 have a radii for the curvature creation. In FIG. 9D a general lintel 74 is formed by the Bolt-A-Blok system 31 by using a series of soldier blocks 76 secured together over the door opening 77. One may note the block 46 are staggered and surround the opening at the perimeter 75. In FIG. 9 E a step system is shown to demonstrate how, operationally, the Bolt-A-Blok system 31 might be used to provide rigid stairs to doorways and openings 77 in a Bolt-A-Blok system 31 structure. The blocks 46 are connected by various bars 44 such as described below in FIG. 11.

FIGS. 10 A through 10 G provide illustrations of attachment devices which are examples shown with the Bolt-A-Blok system 31 prototype wall. Most of these have been described in the paragraphs above so only additional items are explained here. In FIG. 10A an example of an electrical wire or cable 66 is shown projecting from the face of the block 46. The wire 66 has traversed interior to the block 46 in the hollow cavity 49 and is interposed through the space 49A. In FIG. 10C, a door jamb 68 is attached to a space 49A by means of fasteners. In FIG. 10D shims 67 are highlighted. Even though the Bolt-A-Blok system 31 provides an extremely level and plumb system, one skilled in the art of masonry appreciates the need to have a means to correct irregularities. This is expected to be especially helpful in third world locations and in disaster relief situations where the materials may be used or somewhat damaged and will need the ability to allow for the imperfections. In FIG. 10F a wall mounting fastener 69 is shown. One skilled in the art of fasteners appreciates well the plethora of different fastener such as those shown, closed eye bolts, hooks and the like that may be utilized with the Bolt-A-Blok system 31.

Figures 11, 11A, 11B, 11C, 11D, 11E, 11F, 11G, 11H, 11I, 11J, 11K, 11L, 11M:
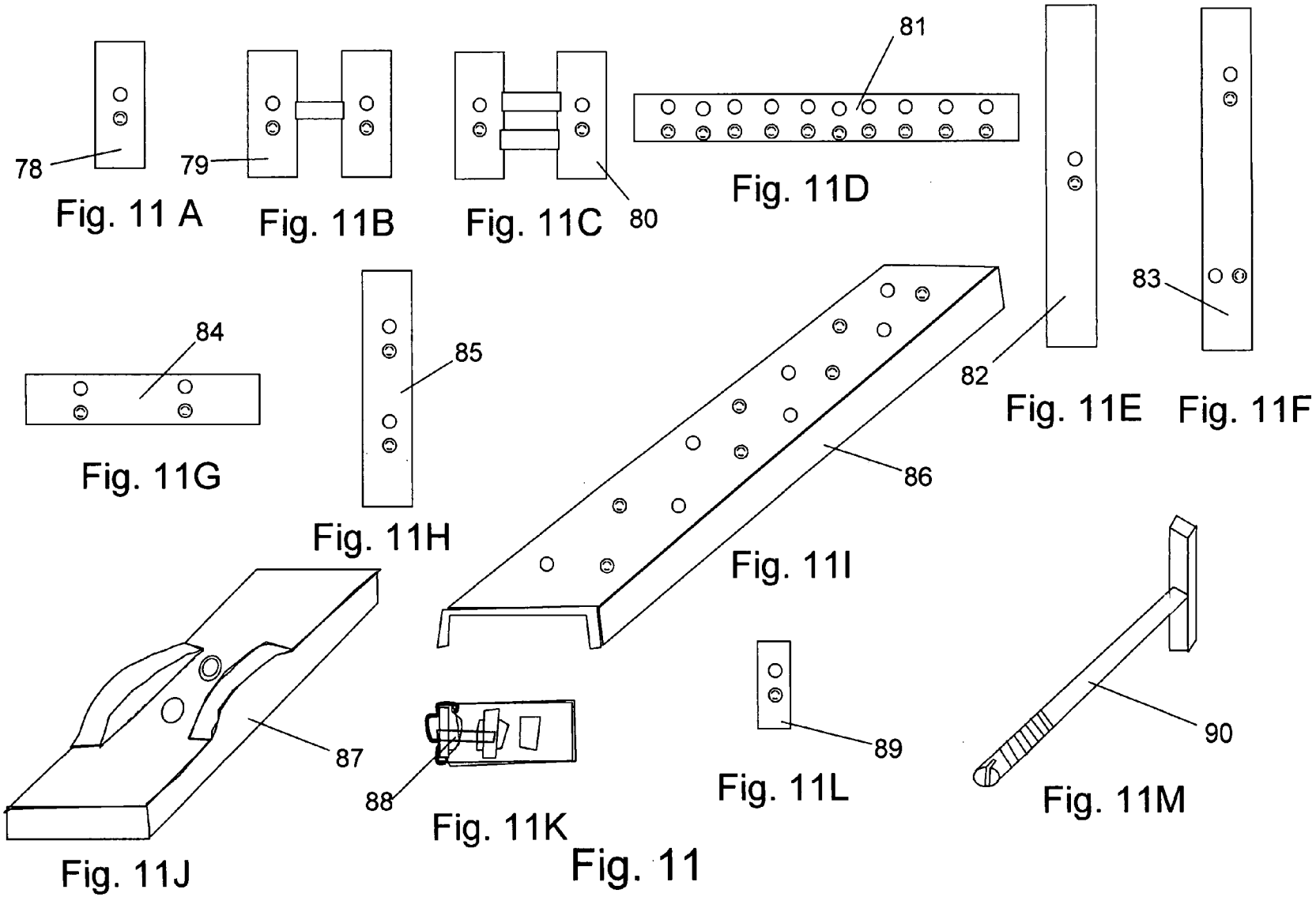
FIGS. 11 A through 11 M show sketches of bars and attachments for the Bolt-A-Blok system.

FIGS. 11 A through 11 M show sketches of bars and attachments for the Bolt-A-Blok system 31. These bars and attachments are exemplary and not limitations of the type of accessories appropriate for the Bolt-A-Blok system 31. The sketches include a standard two hole bar 78; the "H" bar for joining block 79; the "Double H" bar 80 for high strength applications; a lintel plate and connector 81; a double extended bar 82; a turning bar 83 for corners and nonlinear connections; a connector bar 84; double row bar 85; a base plate bar 86; a winged base plate bar 87—metal or non-metal which helps align the block; door frame connection means 88; a smaller version bar for a brick 89; and a tee handled fastener 90 that in theory would not require any tools. In Table B these, the types of blocks and other accessories are further discussed.

TABLE B

ACCESSORIES

| ITEM | DESCRIPTION |
|---|---|
| 1 | Blocks in general<br>Use Different type blocks - Use Bolt-A-Blok system with any hollow cavity masonry shape, block shape, standard shape or special shape building units. Blocks and Bricks, 4" 6" 8" 12", 2 core, 3 core, etc., are typical units. Most all use differing length bars and bolts. |
| 2 | Bolts<br>Use Grade 2 hex head, square, or other type heads useable preferably with a standard or alternatively with a special wrench with minimum tensile strength, 74,000 pounds per square inch<br>Grade 5 hex head cap screw, minimum tensile strength, 120,000 pounds per square inch |
| 3 | T-Bolts<br>Use T bolts to be placed in the spaces. Insert the T bolt crossbar into the core of the block, turn a quarter turn, tighten the washer and nut against the outside of the block. Then attach desired items to the T bolt using another nut. The exterior end (the bolt part that sticks out of the block) of the T bolt must have a screwdriver slot that is exactly parallel to the T bolt crossbar of the T bolt. The T bolt crossbar should have a height of not to exceed 5/16" so it will go thru the spaces in the blocks.<br>Bolt diameters can vary from large to small depending on the load to be attached. Show T bolt drawing.<br>Use extra long thru bolts as necessary<br>Use carriage and toggle bolts |
| 4 | Bar Stock<br>Use Bar stock that can be sheared and have holes punched or manufacture specifically with through or threaded apertures. Threads may be tapped or manufactured into the small hole. Bars can be Zinc Chromate or galvanized coated for military, or whenever needed if necessary to prevent corrosion when they not made of a non-corroding material such as plastic or fiberglass.<br>Bars may be made from flat stock or from hot rolled steel.<br>Example of a typical bar material stock size, for a regular bar for an eight inch block, 3/8 × 1 1/2 × 20'<br>Typical weight for a regular bar for an eight inch block, 1.06 #<br>Bars may also be made from plastic and other metals, in all sizes, to use with different size building unit materials. |
| 5 | Bars<br>Use bars made in all sizes and materials such as metal such as steel, aluminum, rust limiting steel and iron bars, composite materials such as plastic and fiberglass, wood, ETC<br>Bars for every block and material unit size.<br>Typical bar size, 6 15/16" long, for a regular bar for an eight inch concrete block.<br>Extended bar sizes 8" long and up.<br>Extension bars for high strength attachments. Use to connect to other walls including 45 degree connectors at corners and diagonals. |

TABLE B-continued

ACCESSORIES

| ITEM | DESCRIPTION |
|---|---|
| | Ledger bars Connecting bar, about 16" × 2" Takes the place of two bars. |
| | Lintel bar - may have smaller drilled holes to put down-pointing bolts into, to attach wood header to. |
| | 2" wide flat bar lintel. Pairs of holes about every $7\frac{13}{16}$ inches, as necessary for lintel length. Holes go crosswise of bar. Typical for a regular lintel bar for an eight inch concrete block. Some smooth bolt holes could have slightly slotted ends, as the bar spans the opening. |
| | Bars to change from a 12 "block to an 8" block, and to change from other sizes to other sizes. |
| | Connecting bars and H bars for bottom and starter rows. |
| | Connecting bars and H bar for foundation. |
| | Connecting bars and H bars for spanning across bottom openings and top openings. For short lintels And for single horizontal rows. |
| | Turning bars for corners, right and left. |
| | J bars for corners. |
| | T bars for t walls. |
| | Y bars to attach wall ties and angle ties to Bolt-A-Blok system walls. |
| | Cross configuration or Plus shaped bar for corners. |
| | Recess bars for top row or any plate row. |
| | Extension bars with hinges on them. |
| | Military bars may be full block width but also made with "seals" $\frac{3}{16} \times 1 \times 15\frac{5}{8}$, connected with $\frac{5}{16}$ square bar stock, welded into block size trays, 3 cross supports. |
| | Military blast tray mortars, galvanized. Cross supports also $\frac{3}{8}$ diameter rods. Typical for an eight inch concrete block. |
| | Steel extensions bars to attach vault, prison, or heavy doors. |
| | Wood bar with nut insert. |
| | Bars of plastic, and can be thicker and/or wider in size. |
| | Galvanize or zinc-chromate plated the bars and shims. |
| | Military bars may be galvanized. |
| | Thicker bars, wider bars, Plastic bars, and Plated bars. |
| | Use a plastic threaded hole in a plastic bar. |
| | Double length bars for side by side walls. |
| | Welded on sleeve nut on bars if smooth bottom bar needed, such as in starting row. |
| | Use a threaded unit made of stainless steel, steel, brass, etc. sleeve molded, or cast, into a plastic or pressed into a wood bar. |
| | Use regular plastic bars, or use combination plastic bars, or bar, along with the frames, thus combining the bars and fills together. All in one piece. |
| | Use two or more extra bolts in plastic frames, if desired |
| | Dual or triple or more bolt and bar system for 12" or larger blocks, or 8" blocks needing extra strength. |
| | Smaller size bolts for small units like bricks. |
| | Any threaded rod okay in place of bolts. |
| | Hook bolts. |
| | Expanding rivet bolts. |
| | Moly and toggle bolts. |
| | Very large bolts for use with large material units, small bolts for small material units. |
| | Steel and plastic bolts. |
| | Bolts for every block and material unit size. |
| 6 | Brick ledges. - 12 inch blocks, changing to 8 inch blocks on the next course up, create an ideal starting ledge for brick. Extended bars also work well for starting brick ledges. |
| 7 | Aluminum tape, which is weatherproof, can be easily applied to the spaces. Also, ordinary duct tape could be used under furring strips if tyvek is not used and an air seal is desired. Duct tape is typically used on small area wall sections. |
| 8 | Starter plates or boards |
| | Use Anchor Spikes, generally called spikes, to every so often secure the bottom bars to the ground. Therefore one is securing the blocks and the entire block wall to the ground. Spikes can be driven through the smooth hole in the bar directly into the ground. Spikes are $\frac{3}{8}$ diameter rods with a one inch head on them. These spikes vary in length from 2 to 8 feet. Spikes look like oversize nails. The surface of |

TABLE B-continued

ACCESSORIES

| ITEM | DESCRIPTION |
|---|---|
| | Spikes can be smooth or rebar configured. Spikes are useful for landscaping as well as for securing foundations. |
| | Lightweight channel beams. - In place of a starter board, an inverted light weight metal channel could be used, tapped out appropriately so that a one inch hex head cap screw could attach each of the several bars to the channel beam. |
| 9 | Spaces |
| | The spaces are the clear areas between the building units or blocks. One option is to leave the spaces open. However the spaces are very useful in attaching anything to the unit block walls. The spaces may also be closed for decorative purposes or closure purposes. |
| 10 | Fills |
| | Fills are slightly oversize rectangular pieces of wood or plastic, that, after assembling the wall, is driven into the spaces that are located between the bars. |
| | There is a slight taper on the long edge of the fill that is driven into the spaces. This helps start the fill into the space. |
| | A fill is what most things fasten to, such as furring strips or anything. |
| | A fill can be any size to accommodate the building unit sizes, spaces, and the materials to be attached. |
| 11 | Soft Fills |
| | Soft Fills are soft materials that, after assembling the wall, are placed into the spaces, for looks or closure purposes. Soft fills need no glue or adhesive properties, only enough adhesion and cohesion to hold itself in place. |
| | Regular mortar, Thin Mortar, Caulk, Rope caulk, Drywall mud |
| | Any trowel, caulk gun, hand, or finger applied paste. |
| 12 | Furring strips |
| | Furring strips are strips of wood, plastic, or other kinds of materials that are attached to the fills, usually with stainless steel or drywall screws. Furring strips have many purposes, but mainly decorative, closure, and attachments. Furring strips can be plastic or wood; can be different lengths; can be colored, grooved, and decorated with ridges and designs. |
| 13 | Trims |
| | Trims finish the spaces on one side of the wall. Trims are decorative furring strips that have fills attached to them. Trims can simply be attached by driving them into the spaces. |
| | Trims could have half round, oval round, or rectangular shaped faces. |
| | Trims could be all colors and decorated. |
| | Trims could be different materials, wood, plastic, etc. |
| | Trims for corners |
| | Precut lengths |
| 14 | Seals |
| | Seals finish the spaces on both sides of the wall. Seals are like trims except they do not have attached fills. Seals are two decorative furring strips that are attached to each other with long small rods or square shapes. These rods go through the building units or blocks within the spaces. |
| | Seals by themselves have a ladder like appearance. |
| | Seals can be made of plastic wood, or steel. |
| | Seals made of plastic are for decorative and closure purposes. Being all in one piece, seals provide for quick wall assembly and completion. |
| | Seals made of steel provide blast protection, and are often galvanized. |
| 15 | Frames |
| | Frames are bars with fills attached. |
| | Frames are made of steel, plastic, or wood. |
| 16 | Shims |
| | Shims are small squares of steel or plastic. Shims are put under bars to raise and level building units. Shims are used below the bar ends as needed. They are secured in place when the bar is tightened. |
| | Use two or more shims for additional thickness. |
| | Wafers |
| | Wafers are thin adhesive sheets placed in vertical joints for end of block sealing, if desired. |
| | Core materials |
| | Expanding foam, use as insulation, termite protection, etc. |

TABLE B-continued

| ACCESSORIES | |
|---|---|
| ITEM | DESCRIPTION |
| | Poured concrete<br>Poured concrete with rebars |
| 17 | Miscellaneous<br>⅜ rebars, if a Bolt-A-Blok system wall is used with a poured concrete foundation<br>Use Joist brackets, Truss brackets, Brick ties bolted directly to Bolt-A-Blok system walls |
| 18 | Apply Tyvek ™, sheet poly, or other sealing membrane. |
| 19 | Provide Support stands (out rigging) for wall stands for military and regular purposes, supporting one side or both sides with additional buttress structures |
| 20 | Use stainless steel bands to attach the trusses to the bars at the top of the walls. Attach to the bottom chord and/or to the top chord, or both. Whenever possible, use stainless steel bands to attach the trusses to the bars at the top of any of the partition walls. Multiple bands may be used if desired. |
| 21 | Use extended bars to:<br>safely and securely attach ladders to the inside or outside of walls.<br>safely and securely support interior and exterior fire escapes<br>safely and securely support interior and exterior balconies.<br>attach conduit to walls - all directions and sizes<br>attach architectural embellishments, such as foam block, wood, plastic, decorative roof elements, and other.<br>attach and support bar joists.<br>attach lights and lighting.<br>attach downspouts |
| 22 | Use bolted soldier courses when long and shorter lintels are needed, like over doors, windows, and overhead doors. |
| 23 | Use with curved blocks, typical 2 core, based on different radii, different faces such as split, different colors, and more. Bay windows, landscaping, turrets, silos, round piers, decorative bollards, towers, and other structures. Round towers are now possible with Bolt-A-Blok system. Show curved block drawings. |
| 24 | Use stainless steel and/or fiberglass for food tanks, acid tanks, breweries, and more. |
| 25 | Provide Door and window frames that are installed immediately to secure the building |

FIGS. 12 A through 12 D show sketches of a possible deck structures made by the Bolt-A-Blok system 31. Simplistically, in FIG. 12 A an illustration of a simple lateral deck 91 is shown supported by some means 92. In this example illustration the Bolt-A-Blok system 31 is used with a series of blocks 46 in a soldier formation. FIG. 12 B shows the support 92 and highlights the simple bar 44 and bolt 43 components along with the block 46. FIG. 12 C is an illustration from a side view. FIG. 12 D is an illustration demonstrating a person or load 93 being supported by the deck 91. One skilled in the art appreciates that a deck like this might be used for bridges, roadways, roofs, and the like. Additionally a skilled masonry or construction person appreciates the soldier layout is an example. Obviously, a staggered pattern offers additional ways to lay out a deck.

FIGS. 13 A through 13 D show illustrations of tools used in the original prototype of Bolt-A-Blok system 31. They are self explanatory. One skilled in completing prototype build recognizes the original bars 44 having the apertures 50 and 51 being prepared with the means 96 to provide the clear aperture. Likewise a means to provide threads 97 is shown in the illustrations. Finally, various hand drivers 94 and powered drivers are shown. While these are helpful and increase productivity, the Bolt-A-Blok system 31 still only technically needs the wrench 45 to build the system once a person has the blocks 46, the bars 44 and the fasteners 43. Other useful tools that may aid are shown in Table C.

TABLE C

| TOOLS | |
|---|---|
| ITEM | DESCRIPTION |
| 1 | Open Hand wrench |
| 2 | Ratchet |
| 3 | Power or impact Wrench |
| 4 | Grout applicators |
| 5 | Tie wire pliers/cutters |
| 6 | Levels - simple hand held; Laser; Rotating Laser level that can be moved up & down on a rod. |
| 7 | Grout Bags - Grout Bags are what are used to easily put mortar in spaces should that be desired for the finished look. Grout bags hold about 6 to 10 pounds of mortar and typically have a ⅜ tip on them. Grout Bags are easy to use. Grout Bags are used in a similar manner as if one were icing decorations on a cake. Grout Bags cost 5 to 7 dollars retail. Use regular mortar, post fill the spaces and rake the spaces if desired. |
| 8 | Power caulking gun - Use power caulking gun, typically air operated, to apply caulk in spaces, should that be desired. |
| 9 | |

FIGS. 14 A through 14 E show sketches of typical hollow core masonry blocks 46, decorative blocks 99, bricks 100, and a chart 98 of various configurations of hollow cavity blocks. All these types of masonry units are complementary and useful when utilized with the Bolt-A-Blok system 31.

The details mentioned here are exemplary and not limiting. Stated again and well appreciated by one skilled in the art of construction materials, all the examples of the materials may be substituted with other plastics and composite materials that have similar properties and still be within the scope and spirit of this Bolt-A-Blok system 31. Other components specific to describing a Bolt-A-Blok system 31 may be added as a person having ordinary skill in the field of construction as being obvious from the above described embodiment.

OPERATION OF THE PREFERRED EMBODIMENT

The new Bolt-A-Blok system 31 has been described in the above embodiment. The manner of how the device operates is described below. Note well that the description above and the operation described here must be taken together to fully illustrate the concept of Bolt-A-Blok system 31.

FIGS. 15 A through 15 D show illustrations of a construction process for a prototype using the Bolt-A-Blok system 31. In FIG. 15 A the first block 46 is placed on the base 48 and the bars 44. A non-skilled worker 102 begins the construction process. In FIG. 15 B the build continues as a second block 46 is added. Here the worker 102 uses a power driver 95 but could easily use just a standard wrench 45 (not shown). In FIG. 15 C the worker 102 places a third block in a staggered configuration. The build continues until the desired length and height of the wall is realized. Additional workers could work directly along side and near the first worker 102 since no bracing or cure time is required. Once the structure is completed, occupancy is immediate.

There are many, many examples of how the Bolt-A-Blok system 31 may work in different structures. The following Table D is offered as exemplary and not limiting as to how this unique Bolt-A-Blok system 31 can be used.

TABLE D

| EXAMPLES OF USES | |
|---|---|
| ITEM | DESCRIPTION |
| 1 | All general construction.<br>Building Walls, fences, and construction partitions<br>Foundations<br>Piers under floors and bridges<br>Fireplaces and Flues<br>Retaining Walls<br>Decorative Panels - straight or curved<br>Vertical, horizontal, flat and curved wall<br>Self supporting columns<br>Use Bolt-A-Blok system for constructing partition walls<br>Construct segments that can be pre-assembled to any size or shape. Then set in place with a crane, especially in areas where it is not safe to lay building units in a regular manner, such as atop buildings<br>Use with all standard lintels.<br>Roof deck<br>Steps for entry ways and multi-level buildings<br>Assemble Bolt-A-Blok system walls in any configuration, silos, piers, boxes, walls, ell-walls, t-walls, u-shape walls, and square walls |
| 2 | Bridge, levy and highway<br>Levy/Dams Repair broken levies, make new levies, piers. Box shape, solid shape, U-shape, could nest larger and larger square piers or rectangle piers. Strengthen existing levies by putting Bolt-A-Blok system made piers in front of existing walls. Re-enforcement can be positioned under water and need not show. Pre make and drop long units in place for levy control. Pull out with cable.<br>Bridge Structures Breakwater forms. Ultra strong forms for pouring concrete into. Bridge forms and piers. |
| 3 | Disaster and terrorism prevent/relief<br>Entrance Barriers - Such as Gates and vehicle control points<br>Safe room, Safe or Vault - easy builds in high rise structures<br>All structures that require more fire resistant, wind resistant, and attack resistant buildings.<br>Military use for blast protection, quick guard houses, quick prisons<br>Quick construction in third world countries, disaster areas, anywhere.<br>Use Bolt-A-Blok system for rapidly replacing buildings in disaster areas<br>Wind and water resistant - Hurricane, Tornado Tsunami resistant<br>Anti-terror barricades at public buildings<br>Earthquake resistant |
| 4 | Other<br>Store and garden commercial display units<br>Tank walls - such as Swimming pools, fire water tanks, waste water tanks<br>Mobile and/or Manufactured home Building skirts<br>Sound-proof or noise attenuation walls and structures<br>Paint and hazardous material containment structures<br>Desert application, below freezing applications, below water applications, mines. Use in caissons, for underwater construction.<br>Surveyor monuments, mail box posts. bases for equipment such as propane tanks and air conditioning units, wing walls, retaining walls, motels, fire walls, storage unit buildings, schools. |

With this description of the detailed parts and operation it is to be understood that the Bolt-A-Blok system 31 is not to be limited to the disclosed embodiment. The features of the Bolt-A-Blok system 31 are intended to cover various modifications and equivalent arrangements included within the spirit and scope of the description.

What is claimed is:

1. A construction system for building a masonry structure, the construction system comprising:

a masonry unit, the masonry unit comprising:

an uppermost plane;

a lowermost plane substantially parallel to the uppermost plane;

a hollow cavity formed between the uppermost plane and the lowermost plane;

a pair of bars, each bar of the pair of bars being substantially identical and comprising:

a threaded aperture; and a non-threaded aperture, the non-threaded aperture being comparatively larger than the threaded aperture, a first bar of the pair of bars abutting the uppermost plane and a second bar of the pair of bars abutting the lowermost plane; and a fastener configured to rigidly and removably connect to each bar of the pair of bars, the fastener configured for insertion through the non-threaded aperture of the first bar, through the hollow cavity, and into threadable engagement with the threaded aperture of the second bar, with the masonry unit entirely interposed between the first bar and the second bar.

2. The construction system of claim 1, wherein the masonry unit is a unit selected from the group consisting of: a hollow core masonry block and a hollow core masonry brick.

3. The construction system of claim 1, wherein the fastener is a through bolt.

4. The construction system of claim 3, wherein the through bolt is made of a metal selected from the group consisting of steel, stainless steel, high strength alloy steel, and iron.

5. The construction system of claim 1, wherein the pair of bars is made of a metal selected from the group consisting of steel, stainless steel, high strength alloy steel, and iron.

6. The construction system of claim 1, wherein the masonry unit is one of a plurality of masonry units, wherein the pair of bars is one of a plurality of pairs of bars, wherein the fastener is one of a plurality of fasteners, and wherein the pluralities of masonry units, pairs of bars, and fasteners are formed into a structure.

7. The construction system of claim 6, wherein the structure is a structure type selected from the group consisting of: a wall, a foundation, a retaining wall, a deck, a roof deck, a bridge deck, a road deck, a decorative store display panel, a self-supporting column, a pier for floors, a pier for bridges, a barricade, a storage safe, a vault structure, a sound proof enclosure, a levy structure, a damming structure, a blast resistant building, and a fire, wind, and blast resistant building.

8. The construction system of claim 6, wherein the structure is a wall, wherein the wall comprises an uppermost course and a lowermost course of masonry units, and wherein a roof truss is attached to the uppermost course of masonry units.

9. The construction system of claim 8, wherein the roof truss is attached to the uppermost course with a metal band clamp encircling at least one bar of the plurality of pairs of bars and a metal bar of the roof truss.

10. The construction system of claim 1, wherein the hollow cavity is a first hollow cavity, and wherein the fastener is a first fastener, the masonry unit further comprising a second hollow cavity formed between the uppermost plane and the lowermost plane, the construction system further comprising:

a second fastener configured to rigidly and removably connect to each bar of the pair of bars, the second fastener configured for insertion through the non-threaded aperture of the first bar, through the second hollow cavity, and into threadable engagement with the threaded aperture of the second bar, with the masonry unit entirely interposed between the first bar and the second bar.

11. The construction system of claim 10, wherein the first fastener is configured to extend continuously through the first hollow cavity from the uppermost plane to the lowermost plane, and wherein the second fastener is configured to extend continuously through the second hollow cavity from the uppermost plane to the lowermost plane.

12. A system for constructing masonry structures, the system comprising:

a first masonry unit having a first top surface, a first bottom surface, and at least one first cavity formed between the first top surface and the first bottom surface;

a second masonry unit having a second top surface, a second bottom surface, and at least one second cavity formed between the second top surface and the second bottom surface;

a first bar having a first threaded aperture and a first other aperture, the first bar configured for placement against the first bottom surface and configured to span the at least one first cavity;

a second bar having a second threaded aperture and a second other aperture, the second bar configured for placement against the first top surface and against the second bottom surface, the second bar further configured to span the at least one first cavity and the at least one second cavity;

a third bar having a third threaded aperture and a third other aperture, the third bar configured for placement against the second top surface and configured to span the at least one second cavity;

a first fastener bolt having a threaded end and a head end, the first fastener bolt configured for insertion by the threaded end through the second other aperture, through the at least one first cavity, and into threadable engagement with the first threaded aperture, wherein the entire first masonry unit is interposed between the first bar and the second bar, and wherein tightening the threaded end of the first fastener bolt into the first threaded aperture applies a compression force against the first masonry unit between the first bar and the second bar; and a second fastener bolt having a threaded end and a head end, the second fastener bolt configured for insertion by the threaded end through the third other aperture, through the at least one second cavity, and into threadable engagement with the second threaded aperture, wherein the entire second masonry unit is interposed between the second bar and the third bar, and wherein tightening the threaded end of the second fastener bolt into the second threaded aperture applies a compression force against the second masonry unit between the second bar and the third bar.

13. The system of claim 12, wherein the at least one second cavity is a second cavity and a third cavity, the third cavity separate from the second cavity, wherein the third bar is configured to span the second cavity, and wherein the second bar is configured to span the second cavity, the system further comprising:

a fourth bar having a fourth threaded aperture and a fourth other aperture, the fourth bar configured for placement against the second top surface and configured to span the third cavity;

a fifth bar having a fifth threaded aperture and a fifth other aperture, the fifth bar configured for placement against the first top surface and against the second bottom surface and configured to span the third cavity;

a third fastener bolt having a threaded end and a head end, the third fastener bolt configured for insertion by the threaded end through the fourth other aperture, through the third cavity, and into threadable engagement with the fifth threaded aperture, wherein the entire second masonry unit is interposed between the fourth bar and the fifth bar.

14. The system of claim 13, wherein the second fastener extends continuously from the second top surface to the second bottom surface, and wherein the third fastener extends continuously from the second top surface to the second bottom surface.

* * * * *